US010000355B2

(12) United States Patent
Kubota et al.

(10) Patent No.: US 10,000,355 B2
(45) Date of Patent: Jun. 19, 2018

(54) SHEET PROCESSING DEVICE AND IMAGE FORMING DEVICE PROVIDED WITH THE SHEET PROCESSING DEVICE

(71) Applicants: Kazuyuki Kubota, Yamanashi-ken (JP); Eiji Fukasawa, Yamanashi-ken (JP); Ichitaro Kubota, Yamanashi-ken (JP); Hideyuki Kubota, Yamanashi-ken (JP); Hisashi Osada, Yamanashi-ken (JP); Takahiro Nakano, Yamanashi-ken (JP); Hiroyuki Sorita, Yamanashi-ken (JP); Junya Nakajima, Yamanashi-ken (JP); Takuma Kobayashi, Yamanashi-ken (JP); Yuuki Kubota, Yamanashi-ken (JP); Takashi Saito, Yamanashi-ken (JP); Isao Kondo, Yamanashi-ken (JP)

(72) Inventors: Kazuyuki Kubota, Yamanashi-ken (JP); Eiji Fukasawa, Yamanashi-ken (JP); Ichitaro Kubota, Yamanashi-ken (JP); Hideyuki Kubota, Yamanashi-ken (JP); Hisashi Osada, Yamanashi-ken (JP); Takahiro Nakano, Yamanashi-ken (JP); Hiroyuki Sorita, Yamanashi-ken (JP); Junya Nakajima, Yamanashi-ken (JP); Takuma Kobayashi, Yamanashi-ken (JP); Yuuki Kubota, Yamanashi-ken (JP); Takashi Saito, Yamanashi-ken (JP); Isao Kondo, Yamanashi-ken (JP)

(73) Assignee: CANON FINETECH NISCA INC., Misato-shi, Saitama (JP)

( * ) Notice: Subject to any disclaimer, the term of this patent is extended or adjusted under 35 U.S.C. 154(b) by 116 days.

(21) Appl. No.: 15/138,856

(22) Filed: Apr. 26, 2016

(65) Prior Publication Data

US 2016/0236895 A1 Aug. 18, 2016

Related U.S. Application Data

(62) Division of application No. 14/491,493, filed on Sep. 19, 2014, now Pat. No. 9,352,604.

(30) Foreign Application Priority Data

Oct. 31, 2013 (JP) ..... 2013-227096
Oct. 31, 2013 (JP) ..... 2013-227097
Jul. 25, 2014 (JP) ..... 2014-151324

(51) Int. Cl.
*B65H 37/04* (2006.01)
*B42F 3/00* (2006.01)
(Continued)

(52) U.S. Cl.
CPC ..... *B65H 37/04* (2013.01); *B26F 1/02* (2013.01); *B31F 5/00* (2013.01); *B31F 5/06* (2013.01);
(Continued)

(58) Field of Classification Search
CPC . B65H 5/06; B65H 5/08; B65H 37/04; B65H 31/00; B65H 2801/27;
(Continued)

(56) References Cited

U.S. PATENT DOCUMENTS 4,431,127 A * 2/1984 Watanabe ..... B25B 31/005 227/76
7,740,237 B2 6/2010 Mano
(Continued)

FOREIGN PATENT DOCUMENTS

CN 101219615 A 7/2008
CN 101234712 A 8/2008
(Continued)

OTHER PUBLICATIONS

China Patent Office, "Office Action for Chinese Patent Application No. 201410482443.9," dated Apr. 1, 2017.
(Continued)

*Primary Examiner* — Leslie A Nicholson, III
(74) *Attorney, Agent, or Firm* — Manabu Kanesaka

(57) ABSTRACT

A sheet processing device performs saddle stitching binding a bundle of stacked paper sheets, and includes a stacker section temporarily stacking conveyed paper sheets substantially vertically; a stopper regulating the paper sheets stacked in the stacker section; a first binding section provided in the stacker and saddle-stitching, with a metallic staple, a paper sheet bundle regulated by the stopper at a binding position around a center of the paper sheet bundle in a sheet conveying direction; a second binding section saddle-stitching, without using the metallic staple, the paper sheet bundle being regulated by the stopper at the binding position around the center of the paper sheet bundle in the sheet conveying direction; and a folding section folding in half the paper sheet bundle regulated by the stopper at a folding position at which the paper sheet bundle is bound by the first binding section or second binding section.

7 Claims, 25 Drawing Sheets

(51) Int. Cl.

| | |
|---|---|
| ***B65H 5/06*** | (2006.01) |
| ***B65H 5/08*** | (2006.01) |
| ***B65H 31/00*** | (2006.01) |
| ***B26F 1/02*** | (2006.01) |
| ***B31F 5/00*** | (2006.01) |
| ***B31F 5/06*** | (2006.01) |
| ***B42B 4/00*** | (2006.01) |
| ***B42C 1/12*** | (2006.01) |
| ***B42C 19/02*** | (2006.01) |
| ***G03G 15/00*** | (2006.01) |
| ***B65H 35/04*** | (2006.01) |
| ***B65H 37/06*** | (2006.01) |
| ***B65H 45/18*** | (2006.01) |

(52) U.S. Cl.
CPC ..... *B42B 4/00* (2013.01); *B42C 1/12* (2013.01); *B42C 19/02* (2013.01); *B42F 3/003* (2013.01); *B65H 5/06* (2013.01); *B65H 5/08* (2013.01); *B65H 31/00* (2013.01); *B65H 35/04* (2013.01); *B65H 37/06* (2013.01); *B65H 45/18* (2013.01); *G03G 15/00* (2013.01); *B65H 2301/43826* (2013.01); *B65H 2301/4505* (2013.01); *B65H 2701/18292* (2013.01); *B65H 2801/27* (2013.01); *B65H 2801/48* (2013.01); *G03G 15/6541* (2013.01); *G03G 15/6582* (2013.01)

(58) Field of Classification Search
CPC ..... B65H 2301/4505; B26F 1/02; B31F 5/00; B31F 5/06; B42C 1/12; B42F 3/003
USPC .. 270/37, 58.07, 58.08, 58.09, 58.12, 58.17; 412/33, 34, 38
See application file for complete search history.

(56) References Cited

U.S. PATENT DOCUMENTS

| | | | | |
|---|---|---|---|---|
| 7,762,540 | B2 * | 7/2010 | Kushida ..... | B65H 29/58 270/37 |
| 7,905,473 | B2 * | 3/2011 | Tamura ..... | B65H 45/18 270/32 |
| 7,954,798 | B2 | 6/2011 | Taguchi et al. | |
| 8,038,378 | B2 | 10/2011 | Aoki et al. | |

FOREIGN PATENT DOCUMENTS

| | | | |
|---|---|---|---|
| JP | 2000-318918 | A | 11/2000 |
| JP | 2004-193800 | A | 7/2004 |
| JP | 2004-284750 | A | 10/2004 |
| JP | 2005-008417 | A | 1/2005 |
| JP | 3885410 | B2 | 2/2007 |
| JP | 2013-126904 | A | 6/2013 |
| JP | 2014-185017 | A | 10/2014 |

OTHER PUBLICATIONS

Japan Patent Office, "Office Action for Japanese Patent Application No. 2013-227096," dated Apr. 18, 2017.
Japan Patent Office, "Office Action for Japanese Patent Application No. 2013-227097," dated Apr. 18, 2017.
Japan Patent Office, "Office Action for Japanese Patent Application No. 2014-151324," dated Apr. 18, 2017.

* cited by examiner

SHEET PROCESSING DEVICE AND IMAGE FORMING DEVICE PROVIDED WITH THE SHEET PROCESSING DEVICE

RELATED APPLICATIONS

The present application is a divisional application of U.S. Ser. No. 14/491,493, filed on Sep. 19, 2014, which claims priority from Japanese Application No. JP 2013-227096 filed Oct. 31, 2013; No. 2013-227097 filed Oct. 31, 2013 and No. 2014-151324 filed Jul. 25, 2014, disclosure of which is incorporated herein.

BACKGROUND OF THE INVENTION

1. Field of the Invention

The present invention relates to a sheet processing device that binds paper sheets carried out from an image forming device such as a copier or a printer and folds the bound paper sheets at a predetermined folding position and, more particularly, to a sheet processing device capable of performing binding processing suitable for intended use when binding a paper sheet bundle at a portion around a center thereof and then folding the bound paper sheet bundle.

2. Description of the Related Art

There are widely known processing devices that fold a paper sheets carried out from an image forming device in a booklet form. These processing devices are provided with a sheet stacking means for sheet processing. In the sheet stacking means, the paper sheets are stacked in a bundle and are then saddle stitched and folded in a booklet form. Further, in recent years, a binding device that binds a paper sheet bundle without use of a metallic binding needle (metallic staple) in the sheet bundle binding processing and a processing device using such a binding device are being provided.

For example, Jpn. Pat. Appln. Laid-Open Publication No. 2011-201698 discloses a device that performs bookbinding without use of a metallic binding staple so as to enhance recyclability and safety of the bound recording material bundle. In this device, a folding blade and a folding roller apply folding to a paper sheet bundle stacked on a stacker for stacking a plurality of paper sheets in order. A binding mechanism section binds the paper sheet bundle, without use of the metallic staple, in a position at a predetermined interval from a folding position where the paper sheet bundle is subjected to folding by the folding blade and the folding roller.

In the binding processing, the binding mechanism section causes deformation in a thickness direction of the paper sheet bundle that has been subjected to folding by the folding blade and the folding roller so as to bind the paper sheet bundle. More specifically, upper and lower concavo-convex teeth crimping teeth are meshed with each other to cause local deformation in the thickness direction of the paper sheet bundle to make the paper sheets to be engaged with each other.

Besides, there is known a cutter mechanism as a different type of binding mechanism from the binding mechanism using the crimping teeth. The cutter mechanism makes a cut in the paper sheet bundle for deformation of the cut part so as to bind the paper sheet bundle. More specifically, the cutter mechanism binds the paper sheet bundle by means of a U-shaped blade for making a U-shaped cut in the paper sheet bundle, a slit blade for forming a slit-like cut of a length corresponding to a width of the U-shaped blade, and a pushing-in means for pushing the U-shaped cut formed by the U-shaped blade in the slit-like cut.

In either of the above two mechanisms, a portion to which the binding mechanism applies binding is set so as to be separated by a predetermined interval from the folding position of the paper sheet bundle (refer to FIGS. 7 and 11 of Jpn. Pat. Appln. Laid-Open Publication No. 2011-201698). In other words, the folding position and binding position are shifted from each other.

International Publication No. WO2010-067587 discloses a bookbinding system in which an adhesive applying device and a binding device using a metallic staple are connected to each other. Particularly, as illustrated in FIGS. 13, 20, and 24, this system includes a unit provided with the adhesive applying device that applies an adhesive to conveyed paper sheets and a binding/folding unit provided with a needle binding mechanism that applies needle binding processing to the paper sheets and a folding mechanism that folds in half the bound paper sheets are connected in a horizontal direction.

Jpn. Pat. Appln. Laid-Open Publication No. 2011-190021 discloses a sheet processing device having, in a tray, a stapler and a stapleless binder which are configured to bind a paper sheet bundle at its corner portion, in which the stapleless binder is disposed at a position closer to an eject roller for discharging the paper sheet than the stapler.

Jpn. Pat. Appln. Laid-Open Publication No. 2012-45879 discloses a bookbinding device that punches a punch hole while changing hole positions for each paper sheet or a plurality of paper sheets for ring binding. The position of the punch hole is calculated based on the number paper sheets and thickness information.

Japanese Patent No. 4,952,129 discloses a stapler device that uses a paper-made staple in place of a metallic staple in consideration of environment and safety. In this device, an operator manually inserts a paper sheet bundle into a binding processing port. More specifically, Japanese Patent No. 4,952,129 discloses a desk-top type stapler device. In this device, a paper-made staple at the top of a connected staple in which a plurality of paper-made staples are connected in parallel is cut off from the connected staple and shaped into a substantially U-form. Then, both leg portions of the paper-made staple are made to penetrate paper sheets to be bound, bent along the paper sheets to be bound, and then bonded to each other. With this configuration, it is possible to bind the paper sheets to be bound with an easily deformable paper-made staple.

The above-described binding device disclosed in Jpn. Pat. Appln. Laid-Open Publication No. 2011-201698 performs binding processing by deforming the paper sheet bundle itself or by forming a cut bent in a convex shape on one side of a paper sheet bundle and then inserting paper sheets into the formed cut. However, in this configuration, a metallic staple cannot be used for saddle stitching of the paper sheets.

In general, the binding processing not using the metallic staple takes much time for the binding. Thus, in order to realize different binding methods, i.e., a binding method using the metallic staple for raid processing and a binding method not using the metallic staple but using deformation of the paper sheet or cut formed therein for environmental protection, it is necessary to use different devices. That is, it is impossible for one device to realize both the binding method using the metallic staple and that not using the metallic staple.

Further, in the stapleless binding for the saddle stitching disclosed in the above publication, the folding position and binding position are shifted from each other, a saddle stitched booklet cannot be opened at the folding center, thus restricting a print range and causing a feeling of strangeness.

The above International Publication No. WO2010-067587 discloses the bookbinding system in which the adhesive applying device and binding device using the metallic staple are connected to each other. The adhesive applying device and binding device using the metallic staple are configured as separated units, thus increasing an installation area. Thus, a sheet conveying distance from the adhesive applying device not using the metallic staple to a folding device is increased, so that when the binding is performed only by application of the adhesive, peeling or turning-up of the bonded portion may occur on the sheet conveying path.

The above Jpn. Pat. Appln. Laid-Open Publication No. 2011-190021 discloses the stapler that uses a metallic staple to be driven at a corner portion of the paper sheet and stapleless binder that binds the paper sheets, without the metallic staple, by pressing/deforming the paper sheets, but does not mention a positional relationship between the stapler and stapleless binder when the paper sheets are saddle stitched.

The above Jpn. Pat. Appln. Laid-Open Publication No. 2012-45879 discloses a bookbinding device that provides a dedicated ring bind for an end face of the paper sheet bundle to perform ring bookbinding but is not a device that performs processing close to simple ring bookbinding for the paper sheet bundle to be folded.

The above Japanese Patent No. 4,952,129 discloses the manual stapler device that uses a paper-made staple, but does not mention at all automation of the folding device or saddle stitching of the paper sheets.

Under such a situation, a main object of the present invention is to provide a sheet processing device that performs saddle stitching processing that binds a bundle of stacked paper sheets at a position around a center thereof and then folds in half the paper sheet bundle at the binding portion, the device being capable of selectively performing both saddle stitching not using a metallic staple but using a method other than binding using the metallic staple and high-speed saddle stitching by using the metallic staple in accordance with intended use, and capable of reducing a size, and an image forming device provided with the sheet processing device.

SUMMARY OF THE INVENTION

In order to solves the above problems of prior arts, the present invention is configured to provide a sheet processing device including: a stacker section that temporarily stacks conveyed paper sheets in a substantially vertical attitude; a stopper that regulates the paper sheets stacked in the stacker section; a first binding section that is provided in the stacker and saddle-stitches, with a metallic staple, a paper sheet bundle regulated by the stopper at a binding position around a center of the paper sheet bundle in a sheet conveying direction; a second binding section that saddle-stitches, without using the metallic staple, the paper sheet bundle regulated by the stopper at the binding position around the center of the paper sheet bundle in the sheet conveying direction; and a folding section that folds in half the paper sheet bundle regulated by the stopper at a folding position at which the paper sheet bundle is bound by the first binding section or second binding section, wherein the first binding section and second binding section are disposed on both side of the folding section, respectively, in a sheet conveying direction.

Since the first binding section and second binding section are disposed on both side of the folding section, respectively, it is possible to utilize a space of the stacker section more effectively than a case where both the first and second binding sections are provided on one side of the folding section, thereby making the device compact as a whole even though the two types of binding devices are disposed in the same unit.

BRIEF DESCRIPTION OF THE DRAWINGS

FIGS. 5A to 5D are explanatory views of a procedure of folding the paper sheet bundle bound with the metallic staple illustrated in FIGS. 3B and 4, in which FIG. 5A is a view illustrating a state where the paper sheet bundle bound with the metallic staple is set at the folding position, FIG. 5B is an initial state view of operation of folding the paper sheet bundle from a leg portion side of the metallic staple, FIG. 5C is a view illustrating a state where the paper sheet bundle and metallic staple are inserted into a nip position between folding rollers, and FIG. 5D is a carry-out state view where the paper sheet bundle and metallic staple are folded by the folding rollers;

FIGS. 7A to 7C are explanatory views each illustrating a paper-made staple loaded into the saddle stitching stapler illustrated in FIG. 6, in which FIG. 7A is an explanatory view illustrating a state where a plurality of the paper-made staples are connected, FIG. 7B is a perspective view of the paper-made staple, and FIG. 7C is a cross-sectional view illustrating a state where the paper sheet bundle is bound with the paper-made staple;

FIGS. 8A to 8C are explanatory views each illustrating a mechanism that binds the paper sheet bundle using the saddle stitching stapler illustrated in FIG. 6, in which FIG. 8A is an explanatory view illustrating a state where a cutter blade starts punching the paper sheet bundle, FIG. 8B is an explanatory view illustrating a state where the punching operation by the cutter blade is completed and, at the same time, insertion of the paper-made staple through the paper sheet bundle is completed, and FIG. 8C is an explanatory view illustrating a state where leg portions of the paper-made staple are bent inward and bonded to each other;

FIGS. 10A to 10D are explanatory views of a procedure of folding the paper sheet bundle bound with the paper-made staple illustrated in FIGS. 6 to 9, in which FIG. 10A is a view illustrating a state where the paper sheet bundle bound with the paper-made staple is set at the folding position, FIG. 10B is an initial state view of operation of folding the paper sheet bundle and paper-made staple from the leg portion side, FIG.

10C is a view illustrating a state where the paper sheet bundle and paper-made staple are inserted into the nip position between folding rollers, and FIG. 10D is a carry-out state view where the paper sheet bundle and paper-made staple are folded by the folding rollers;

FIGS. 15A and 15B each illustrate a paper sheet bundle that has been subjected to saddle stitching and folding processing by the present invention, in which FIG. 15A illustrates a paper sheet bundle saddle stitched with the metallic staple and then folded in the center, and FIG. 15B illustrates a paper sheet bundle saddle stitched with the paper-made staple and then folded in the center;

FIGS. 22A and 22B are each a cross-sectional view of a mechanism of a punch device of FIG. 21 adopted in the fifth embodiment, disposed on the downstream side of the folding section, in which FIG. 22A is a cross-sectional view, and FIG. 22B is a front view as viewed from the discharge side;

FIGS. 23A to 23C are explanatory views each illustrating a mechanism that binds, using the saddle stitching stapler for paper-made staple of FIG. 6, the folded paper sheet bundle by driving the paper-made staple into the punch holes punched at a back of the folded paper sheet bundle, in which FIG. 23A illustrates a state where a cutter blade starts being inserted into the punch hole of the folded paper sheet bundle, FIG. 23B illustrates a state where the insertion of the cutter blade and paper-made staple set thereto into the punch hole of the folded paper sheet bundle is completed, and FIG. 23C illustrates a state where the leg portions of the paper-made staple are bent inward and bonded to each other;

DESCRIPTION OF THE PREFERRED EMBODIMENTS

Fundamental Primary Embodiment

Figure 1:
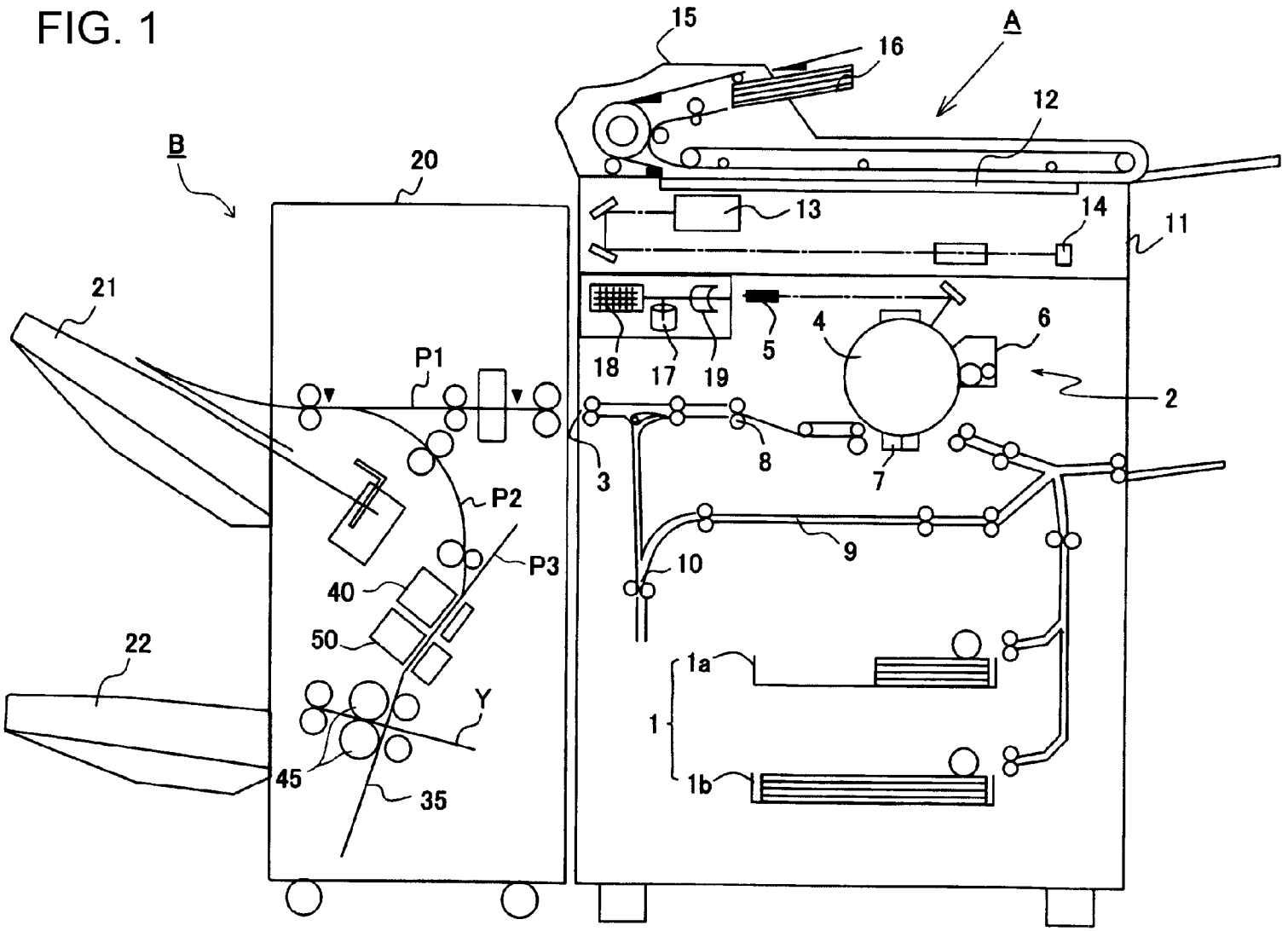
FIG. 1 is an explanatory view illustrating an entire configuration of an image forming device according to the present invention.
Figure 2:
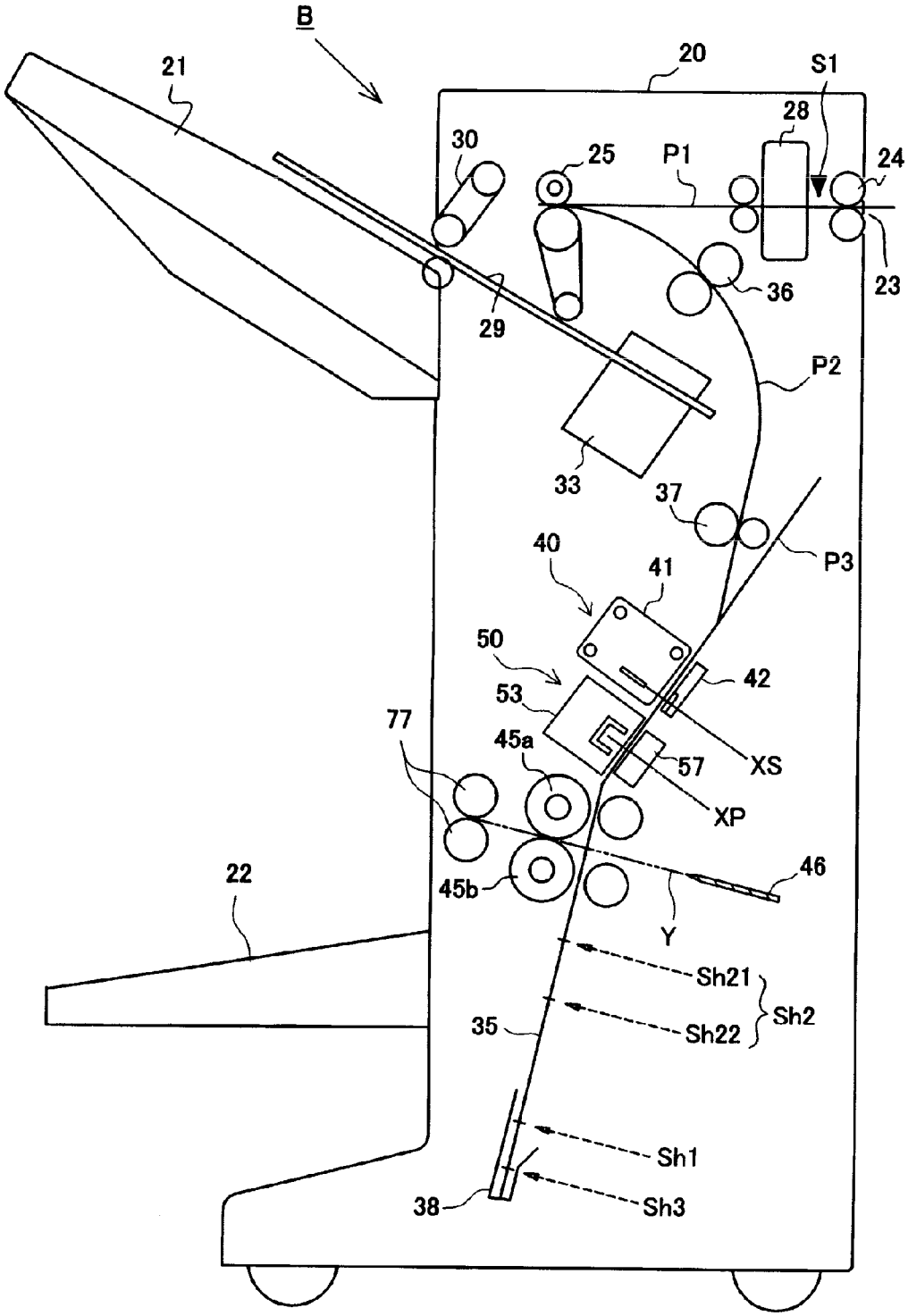
FIG. 2 is an explanatory view illustrating a first embodiment of a sheet processing device according to the present invention.

The present invention will be described below based on illustrated preferred embodiments. FIG. 1 is an explanatory view illustrating an entire configuration of an image forming device according to the present invention, and FIG. 2 is an explanatory view illustrating a sheet processing device embodying the present invention. As illustrated in FIG. 1, the image forming device includes an image forming device A and a sheet processing device B, and the sheet processing device B incorporates therein a saddle stitching stapler 40 for metallic staple and a saddle stitching stapler 50 for paper-made staple.

[Configuration of Image Forming Device]

The image forming device A illustrated in FIG. 1 feeds a paper sheet from a sheet supply section 1, performs printing in an image forming section 2, and discharges the paper sheet after printing from a main body discharge port 3. Paper sheets of a plurality of sizes are accommodated in sheet cassettes 1*a* and 1*b*, and the sheet supply section separates, one from the other, paper sheets of a specified size and feeds them one by one to the image forming section 2. The image forming section 2 includes an electrostatic drum 4 and a print head (laser emitter) 5, a developing unit 6, a transfer charger 7, and a fixing unit 8 which are disposed around the electrostatic drum 4. An electrostatic latent image is formed on the electrostatic drum 4 using the laser emitter 5, the developing unit 6 adds toner to the image, the transfer charger 7 transfers the image onto the paper sheet, and the fixing unit 8 thermally-fixes the image. The paper sheet with thus formed image is sequentially carried out from the main body discharge port 3. A reference numeral 9 in FIG. 1 denotes a circulation path, which is a path for two-side printing in which the paper sheet printed on the front side from the fixing unit 8 is reversed via a main body switchback path and is fed to the image forming section 2 again for printing on the back side of the paper sheet. The paper sheet thus printed on both sides is reversed in the main body switchback path 10 and is carried out from the main body discharge port 3.

A reference numeral 11 in FIG. 1 denotes an image reader, where a document sheet set on a platen 12 is scanned by a scan unit 13 and is electrically read by a photoelectric conversion element 14 through a reflective mirror and a condensing lens. This image data is subjected to, e.g., digital processing by an image processor and is subsequently transferred to a data storage section 17, and an image signal is sent to the laser emitter 5. A reference numeral 15 denotes a document feeder that feeds document sheets stored in a stacker 16 to the platen 12.

The image forming device A having the above-described configuration is provided with a control section (controller). Image forming conditions are set via a controller panel 18, for example, printout conditions such as a sheet size specification, a color or black-and-white printing specification, a print copy count specification, single- or double-side printing specification, and enlarged or reduced printing specification. On the other hand, in the image forming device A, image data read by the scan unit 13 or transferred through an external network is stored in the data storage section 17. The image data stored in the data storage section 17 is transferred to a buffer memory 19, which sequentially transfers data signals to the laser emitter 5.

Together with the image forming condition, a sheet processing condition is also input from the controller panel 18. For example, the sheet processing condition includes a "printout mode", a "side edge staple-binding mode", a "metallic staple saddle stitching mode", a "paper-made staple saddle stitching mode", and a "simple ring mode". Then, the image forming device A forms an image on the paper sheet according to the image forming condition and sheet processing condition. Details of the above modes will be described later.

[Configuration of Sheet Processing Device]

The sheet processing device B connected to the above described image forming device receives the paper sheet onto which an image has been formed from the main body discharge port 3 of the image forming device A and then performs one of the following operations: (1) accommodating the received paper sheet in the first sheet discharge tray ("printout mode"); (2) aligning the paper sheets from the main body discharge port 3 in a bundle, staple-binding the paper sheet bundle at the side edge, and then accommodating the resultant paper sheet bundle in the first sheet discharge tray 21 ("side edge staple-binding mode"); (3) conveying the paper sheet from the main body discharge port 3 to the stacker section 35, aligning the paper sheets stacked in the stacker section 35 in a bundle, saddle stitching the paper sheet bundle using the saddle stitching stapler 40 for metallic staple, folding the saddle stitched paper sheet bundle in a booklet form, and accommodating the resultant paper sheet bundle in the second sheet discharge tray 22 ("metallic staple saddle stitching mode"); (4) conveying the paper sheet from the main body discharge port to the stacker section 35, aligning the paper sheets stacked in the stacker section 35 in a bundle, saddle stitching the paper sheet bundle using the saddle stitching stapler 50 for paper-made staple, folding the saddle stitched paper sheet bundle in a booklet form, and accommodating the resultant paper sheet bundle in the second sheet discharge tray 22 ("paper-made staple saddle stitching mode"); (5) punching punch holes at predetermined positions of the paper sheet from the main body discharge port 3 by a single-sheet punch unit 28, conveying the paper sheet to the stacker section 35, aligning the paper sheets stacked in the stacker section 35 in a bundle, using the saddle stitching stapler 50 for paper-made staple to bind the paper sheet bundle by driving the paper-made staple at positions corresponding to the punch holes so as to achieve simple ring binding, folding the bound paper sheet bundle in a booklet form, and accommodates the resultant paper sheet bundle in the second sheet discharge tray 22 ("simple ring mode").

Thus, as illustrated in FIG. 2, the sheet processing device B is provided with the first sheet discharge tray 21 and second sheet discharge tray 22 in a casing 20. Further, the device B is provided with a sheet carry-in path P1 having a carry-in port 23 continued to the main body discharge port 3. The sheet carry-in path P1 is formed of a straight-line path in a substantially horizontal direction in the casing 20. Further, there are provided a first switchback conveying path P11 and a second switchback conveying path P2 that branch off from the sheet carry-in path P1 to transport a paper sheet in an inverse direction. The first switchback conveying path SP11 branches off from the sheet carry-in path P1 to the downstream side of the sheet carry-in path P1, the second switchback conveying path P2 branches off from the sheet carry-in path P1 to the upstream side of the sheet carry-in path P1, and the paths P11 and P2 are disposed spaced apart from each other.

In such a path configuration, there are disposed in the sheet carry-in path P1, there are disposed a carry-in roller 24 and sheet discharge roller 25, and the rollers 24 and 25 are coupled to a drive motor M1 (not illustrated) capable of rotating forward and backward. Further, there is disposed in the sheet carry-in path P1, a not-illustrated path switching piece 27 for guiding a paper sheet to the second switchback conveying path P2, and the piece 27 is coupled to an operation means such as a solenoid. Further, the sheet carry-in path P1 has, on the downstream side of the carry-in roller 24, a single-sheet punch unit 28 for punching the paper sheet from the carry-in port 23. The illustrated single-sheet punch unit 28 is configured to be detachably mounted to the casing 20 depending on a device specification.

The following describes a configuration of the second switchback conveying path P2 branching off from the sheet carry-in path P1. As illustrated in FIG. 2, the second switchback conveying path P2 is located in a substantially vertical direction inside the casing 20. A conveying roller 36 is located at an inlet of the second switchback conveying path P2, and a conveying roller 37 is located at an outlet of the second switchback conveying path P2. A stacker section 35 constituting a second processing tray that aligns and temporarily stacks, in a substantially vertical attitude, the paper sheets fed along the second switchback conveying path P2 is provided downstream of the second switchback conveying path P2.

A third switchback path P3 branching off from a lower end of the second switchback conveying path P2 is provided above the stacker section 35. The third switchback path P3 is a path for switching back the paper sheet once carried in the stacker section 35. The third switchback path P3 can guide carrying-in of the next paper sheet and ensure the page order of the paper sheets.

[Stacker Section]

The stacker section 35 is formed of a guide member that guides the paper sheet being conveyed. The stacker section 35 is configured so that the paper sheets are loaded and housed thereon. The illustrated stacker section 35 is connected to the second switchback conveying path P2 and located in a center portion of the casing 20 so as to extend in the substantially vertical direction. This allows the device to be compactly configured. The stacker section 35 is shaped to have an appropriate size to house maximum sized paper sheets. There are disposed along the stacker section 35 a saddle stitching stapler 40 for metallic staple (first binding section) that performs saddle stitching using a metallic staple and a saddle stitching stapler 50 for paper-made staple (second binding section) that performs saddle stitching using a paper-made staple. Further, the stacker section 35 is curved so as to project toward a folding roller 45 side. In the example of FIG. 2, the saddle stitching stapler 50 for paper-made staple is disposed on an upstream side of the folding roller 45, and the saddle stitching stapler 40 for metallic staple is disposed above the saddle stitching stapler 50 for paper-made staple. Thus, the saddle stitching stapler for paper-made staple that uses the paper-made staple having a binding force smaller than that of the metallic staple is disposed closer to the folding roller 45. In other words, an interval between the saddle stitching stapler 50 for paper-made staple and folding roller 45 is set smaller than an interval between the saddle stitching stapler 40 for metallic staple and folding roller 45. This prevents coming-off or turning-up of the paper-made staple.

The arrangement described above is a first embodiment, and various embodiments may be adopted as long as the saddle stitching stapler 50 for paper-made staple is disposed closer to the folding roller 45. The other embodiments will be described below.

On the downstream side of the saddle stitching stapler 40 for metallic staple and saddle stitching stapler 50 for paper-made staple, there is disposed a folding roller 45 constituted by a pair of rollers: an upper folding roller 45*a* and a lower folding roller 45*b* that are brought into pressure contact with each other so as to fold in half the paper sheet bundle that has been and subjected to binding at its center. A plate-like folding blade 46 is disposed at a position facing the pressure contact position of the folding roller 45. The folding blade 46 pushes the paper sheet bundle 100 into the folding roller 45 to start folding operation of the paper sheet bundle 100. The folding operation will be described later for the paper sheet bundle bound by the saddle stitching stapler 40 for metallic staple and paper sheet bundle bound by the saddle stitching stapler 50 for paper-made staple, respectively.

A leading end regulating member (hereinafter, referred to as stopper 38) regulating a sheet leading end in the conveying direction is located downstream of the guide of the stacker section 35. The stopper 38 is supported by a guide rail and the like so as to be movable along the stacker section 35. The stopper 38 is moved between positions Sh1, Sh21, Sh22 and Sh3, illustrated in the figure, by a shift means controller MS.

The carrying-in operation of the paper sheet bundle to the stacker section will be described. First, with the stopper 38 set at the lowermost position, the carrying-in of the paper sheet is waited for. When the stopper 38 is set at the illustrated position Sh3, a rear end of the paper sheet (bundle) supported by the stacker section 35 enters the third switchback path P3, so that a subsequent paper sheet fed from the second switchback conveying path P2 in this state is reliably stacked on the stacked paper sheets. Thereafter, when the stopper 38 is set at the illustrated position Sh22, a center of the paper sheet (bundle) is positioned to a binding position XP of the saddle stitching stapler 50 for paper-made staple. When the stopper 38 is positioned at the illustrated position Sh21, the center of the paper sheet (bundle) is positioned to a binding position XS of the saddle stitching stapler 40 for metallic staple.

Then, when the stopper 38 is set at the illustrated position Sh1, the center of the paper sheet bundle stapled by a metallic staple 40*a* or paper-made staple 60 is positioned to a folding position Y which is a position at which the folding blade 46 is inserted between folding rollers 45. Thus, the positions Sh1, Sh21, Sh22, and Sh3 correspond respectively to a folding position (Sh1), a binding position (Sh21, Sh22), and a subsequent sheet receiving position (Sh3). The position of the stopper 38 is controlled by the shift controller MS.

The stacker section 35 has, on its downstream side in the sheet conveying direction, an aligning member 39 to be described later using FIG. 11. The aligning member 39 aligns the paper sheets carried in the stacker section 35 and supported by the stopper 38 with each other with respect to the width direction thereof.

The following describes configuration of the saddle stitching stapler 40 for metallic staple and saddle stitching stapler 50 for paper-made staple and then describes folding operation performed by the folding roller and folding blade 46 for respective cases where the saddle stitching staplers 40 and 50 are used.

[Saddle Stitching Stapler for Metallic Staple]

The saddle stitching stapler 40 for metallic staple that performs saddle stitching by binding the paper sheet bundle with a metallic staple 40*a* which is a metallic staple needle is disposed along the stacker section 35 and binds the paper sheet bundle 100 stacked in the stacker section 35 in an aligned state at a center portion thereof. A configuration of the saddle stitching stapler 40 for metallic staple will be described based on FIGS. 3A and 3B. The saddle stitching stapler 40 for metallic staple includes a driver unit 41 and a clincher 42. The driver unit 41 includes a head member 41*a* that inserts the metallic staple 40*a* through the paper sheet bundle 100 set at the binding position, a cartridge 41*b* housing the metallic staples 40*a*, a drive cam 41*c*, and a staple motor MD that drives the drive cam 41*c*. The head member 41*a* as a frame body incorporates, as illustrated in FIG. 3B, a driver member 41*e*, a former 41*f*, and a bending block 41*g* which are vertically arranged in this order from above. The driver member 41*e* and former 41*f* are vertically slidably supported by the head member 41*a* so as to be reciprocatable between a top dead center and a bottom dead center. The bending block 41*g* is fixed to the head member 41*a* as a molding die that bends the metallic staple 40*a* having a linear shape into a U-shape.

The cartridge 41*b* incorporating the metallic staples 40*a* is attached to an inside of the frame and sequentially supplies the metallic staples 40*a* to the bending block 41*g*. The driver member 41*e* and former 41*f* are connected to a drive lever 41*d* swingably mounted to the frame and driven to move between the top dead center and bottom dead center. An energy accumulating spring (not illustrated) that vertically drives the drive lever 41*d* is provided in the frame. Further, there are provided a drive cam 41*c* that stores energy in the energy accumulating spring 41*c* and a staple motor MD that drives the drive cam 41*c*.

The clincher 42 is disposed at a position facing the above-described driver unit 41 across the paper sheet bundle 100. The illustrated clincher 42 is constituted by a structure separated from the driver unit 41 and bends a leading end (needle point) of the metallic staple 40*a* inserted through the paper sheet bundle 100 by the driver unit 41. To this end, the clincher 42 has a bending groove for bending the leading end of the metallic staple 40*a*. Particularly, the illustrated clincher 42 has a plurality of bending grooves 42*a*1 and 42*a*2 which are arranged in the width direction of the paper sheet bundle 100 stacked in the stacker section 35, and the driver units 41 corresponding to the bending grooves 42*a*1 and 42*a*2 staple-bind the paper sheet bundle 100 at the plurality of positions in the sheet width direction.

Figure 3A:
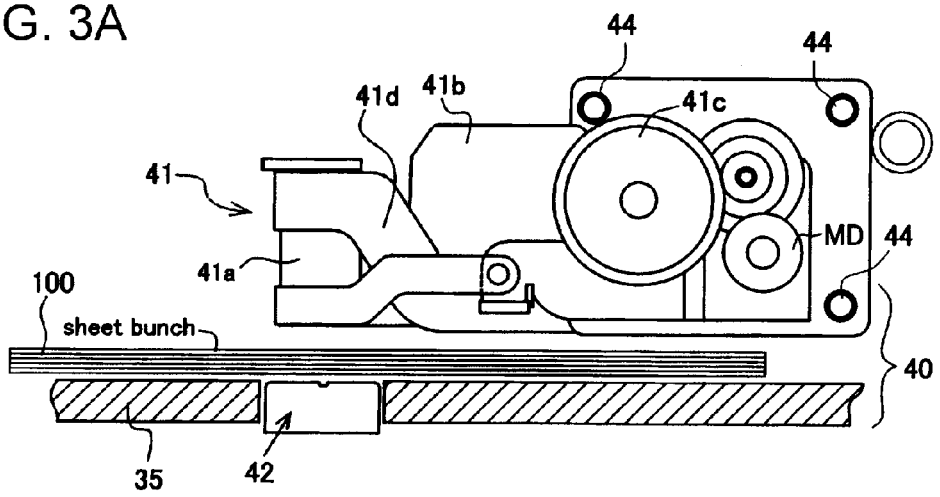
FIGS. 3A and 3B are explanatory views each illustrating a saddle stitching stapler for metallic staple (first binding section) illustrated in FIG. 2.
Figure 3B:
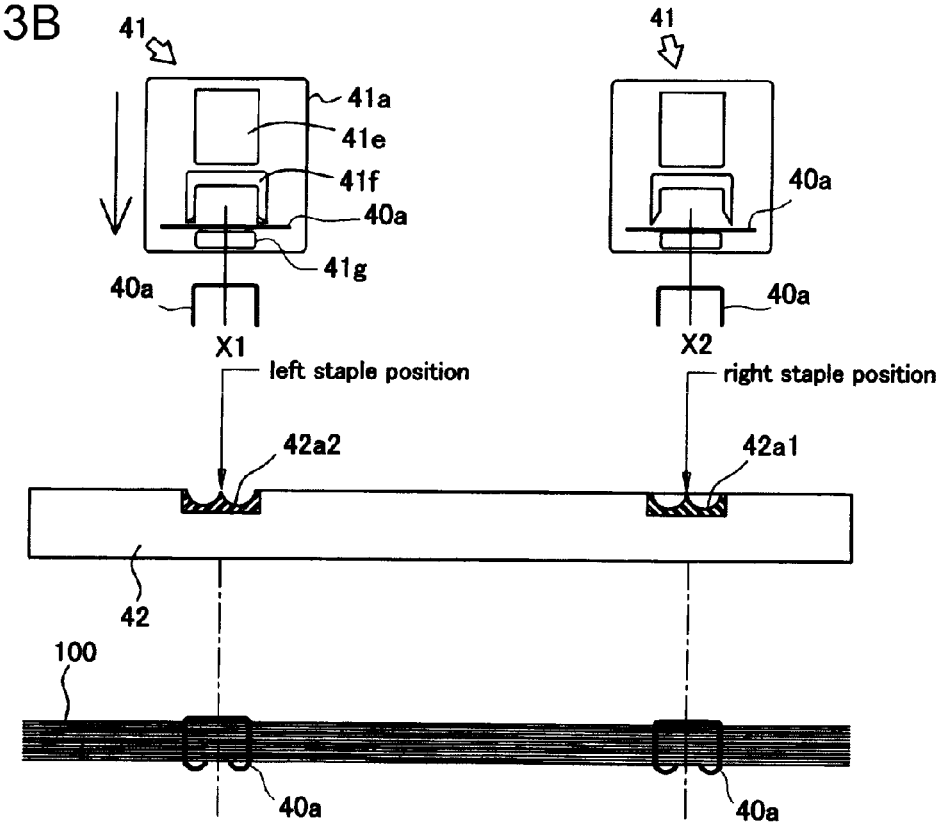

That is, as illustrated in FIG. 3A, the driver unit 41 is fixed and supported on the paper sheet bundle 100 by stapler support rods 44. With this configuration, it is possible to staple-bind the paper sheet bundle 100 supported by the stacker section 35 at the left and right positions without moving the clincher 42 but with the clincher 42 in a fixed state.

The clincher 42 may be configured to have a wing member (not illustrated) for bending the leading end of the staple and to swing/rotate the wing member in conjunction with (in synchronization with) the needle point to be inserted through the paper sheet bundle 100 by the driver unit 41. Thus, in the present embodiment, the clincher 42 may adopt either a standard (eyeglass) clinch type or a flat clinch type.

In the configuration described above, a rotation of the staple motor MD causes the driver cam 41*c* to press down the drive lever 41*d* through the energy accumulating spring from the top dead center to bottom dead center, with the result that the driver member 41*a* and former 41*f* connected to the drive lever 41*d* move down from the top dead center to bottom dead center. The drive member 41*e* is formed of a plate-like member so as to press down a back part of the stapler bent in a U-shape, and the former 41*f* is formed of a U-shaped member as illustrated in FIG. 4B so as to bend the stapler into a U-shape with the bending block 41*g*. That is, the metallic staple 40*a* is supplied from the above-described cartridge 41*b* to bending block 41*g*. The linear metallic staple 40*a* is press-molded into the U-shape between the former 41*f* and bending block 41*g*. Then, the driver member 41*e* forcefully presses down the U-shaped the metallic staple 40*a* toward the paper sheet bundle 100 to thereby insert the metallic staple 40*a* through the paper sheet bundle 100.

[Paper Sheet Bundle Bound by Saddle Stitching Stapler for Metallic Staple]

Figure 4:
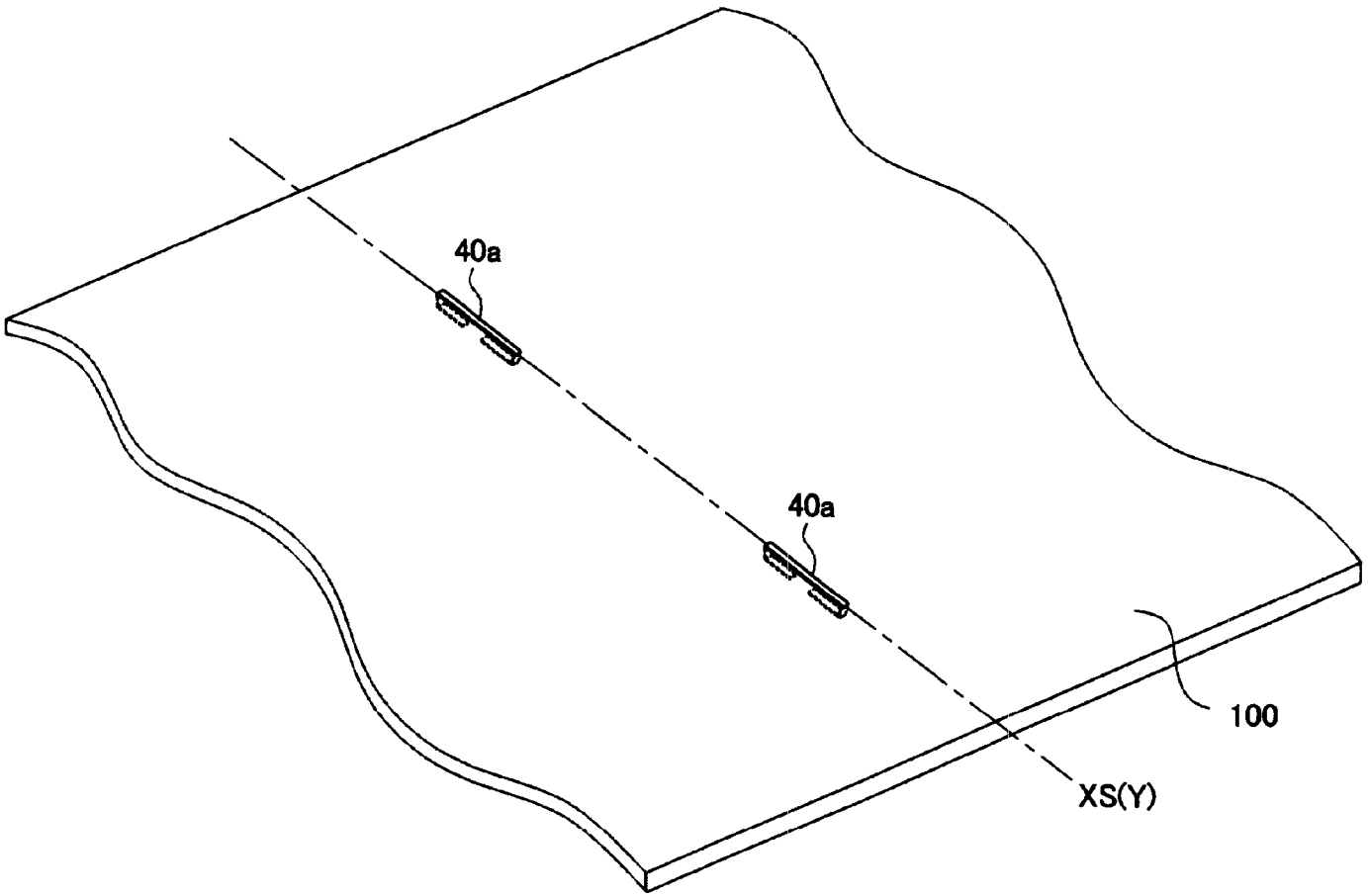
FIG. 4 is an explanatory view illustrating a paper sheet bundle before being folded, bound with a metallic staple of FIG. 3B.

FIG. 4 illustrates a state where the paper sheet bundle is saddle stitched by the saddle stitching stapler for metallic staple at the center of the paper sheet bundle in the sheet conveying direction. In FIG. 4, the back part of the metallic staple 40*a* is illustrated. As illustrated in FIG. 4, the metallic staple 40*a* is directed in parallel to the sheet folding position Y so as to overlap the same. Therefore, the metallic staple 40*a* can be pushed between the folding rollers 45*a* and 45*b* of the folding roller 45 by the folding blade 46 to be described below.

[Folding Processing of Paper Sheet Bundle Bound by Metallic Staple]

The following describes a folding operation of the paper sheet bundle saddle stitched with the metallic staple 40*a* with reference to FIG. 5. As illustrated in FIG. 2, there are disposed, at the folding position set on the downstream side of the saddle stitching stapler 40 for metallic staple and saddle stitching stapler 50 for paper-made staple, the pair of folding rollers 45*a* and 45*b* for folding the paper sheet bundle 100 and the folding blade 46 for inserting the paper sheet bundle 100 into a nip position between the folding rollers 45*a* and 45*b*. As illustrated in FIG. 5A, the folding roller 45 is constituted by the pair of folding rollers 45*a* and 45*b* brought into pressure contact with each other by elastic forces of springs 45*as* and 45*bs*. The folding rollers 45*a* and 45*b* each have a length corresponding to substantially the maximum width of the paper sheet.

The pair of rollers 45*a* and 45*b* are each formed of a material, such as a rubber, having a large friction coefficient. This is for conveying the paper sheet bundle in a roller rotation direction while folding the same by a soft material such as a rubber, and the rollers 45*a* and 45*b* may be formed by applying lining to a rubber material. Although not illustrated, the folding roller 45 has a concavo-convex shape, and a predetermined gap is formed in the sheet width direction. A binding portion of the metallic staple 40*a* and a blade tip of the folding blade 46 also having a concavo-convex shape enter the gap.

The following describes an operation of folding the paper sheet bundle using the folding roller 45 with reference to FIGS. 5A to 5D. The folding roller 45 is constituted by the upper and lower folding rollers 45*a* and 45*b* and disposed at an intermediate portion of the stacker section 35. The folding blade 46 having, at a leading end thereof, a knife edge is disposed at a position facing the folding roller 45 across the paper sheet bundle 100. The folding blade 46 is supported by a device frame so as to be reciprocatable between a standby position illustrated in FIG. 5A to a nip position illustrated in FIG. 5C.

Figure 5A:
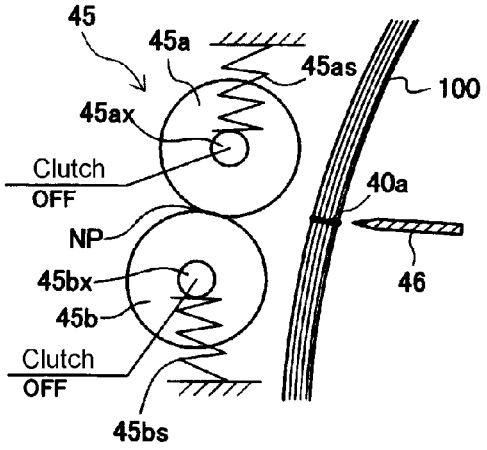

A leading end of the paper sheet bundle 100 supported by the stacker section 35 is stopped by the stopper 38 at the position Sh1 in a state illustrated in FIG. 5A, and a position to be folded is positioned to the folding position Y with the metallic staple driven at this position. After acquiring a completion signal indicating completion of the setting of the folding position, a drive controller ("sheet bundle folding operation controller 97" to be described later) turns a clutch means OFF.

Figure 5B:
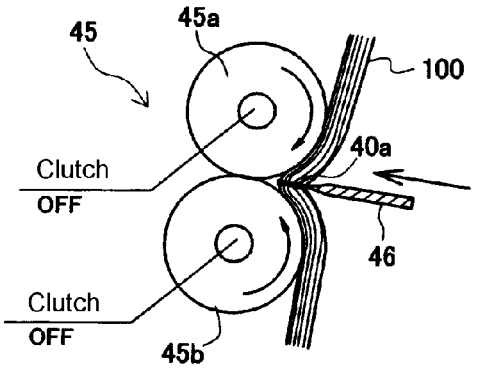
Figure 5C:
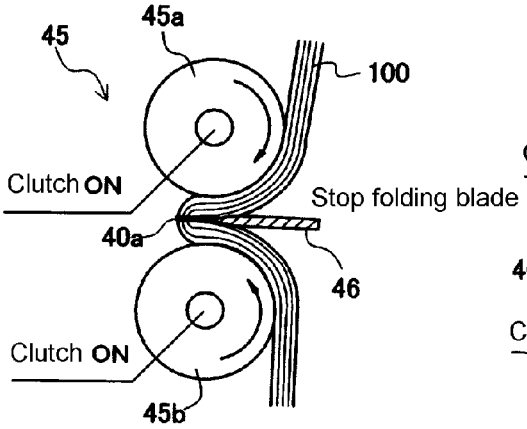

The sheet bundle folding operation controller 97 moves the folding blade 46 from the stand-by position toward nip position at a predetermined speed. Then, as illustrated in FIG. 5B, the paper sheet bundle 100 is bent by the folding blade 46 at the folding position and is inserted between the first and second rollers 45*a* and 45*b*. At this time, the first and second rollers 45*a* and 45*b* are rotated by the movement of the paper sheet bundle by the folding blade 46. Then, the sheet bundle folding operation controller 97 stops a blade drive motor (not illustrated) after elapse of an estimated time period during which the paper sheet bundle 100 reaches a predetermined nip position to stop the folding blade 46 at a position illustrated in FIG. 5C. Around this time, the sheet bundle folding operation controller 97 turns the clutch means ON to drive/rotate the folding roller 45.

Figure 5D:
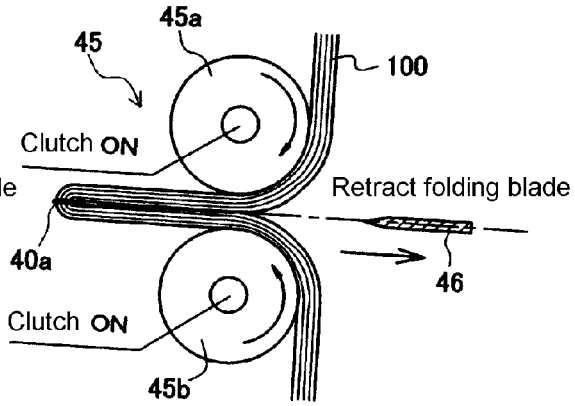

Then, the paper sheet bundle 100 is fed in a delivery direction (leftward in FIG. 5D). Thereafter, as illustrated in FIG. 5D, the sheet bundle folding operation controller 97 moves the folding blade 46 positioned at the nip position to the standby position concurrently with the delivery of the paper sheet bundle 100 by the folding roller 45.

When the thus folded paper sheet bundle 100 is pushed between the folding rollers 45*a* and 45*b*, an outermost paper sheet contacting a roller surface is not drawn completely between the rotating rollers. That is, the folding roller is rotated following the movement of the inserted (pushed) paper sheet bundle, preventing only the sheet contacting the roller from being caught between the rollers prior to the other paper sheets. Further, since the roller is rotated following the movement of the inserted paper sheet bundle, the roller surface and the outermost paper sheet contacting the roller surface are not rubbed with each other, so that image rubbing-off does not occur.

The metal staple 40*a* driven into the paper sheet bundle by the saddle stitching stapler 40 for metallic staple is configured to bind the paper sheet bundle 100 with leg portions thereof facing the folding blade 46 side, and the folding blade 46 pushes the leg portions when folding the paper sheet bundle 100. Further, the back part of the metallic staple 40*a* is directed in parallel to or in a direction overlapping a folding line of the folding position Y. Thus, the arrangement direction of the staple 40*a* does not hinder the folding operation.

[Saddle Stitching Stapler for Paper-Made Staple]

The following describes the saddle stitching stapler for paper-made staple. As illustrated in FIG. 2, the saddle stitching stapler 50 for paper-made staple is disposed closer to the folding roller 45 than the saddle stitching stapler 40 for metallic staple. The saddle stitching stapler 50 for paper-made staple is constituted by a driver unit 53 that drives the paper-made staple 60 into the paper sheet bundle 100 and a clincher unit 57 that bends leg portions 61 and 62 of the driven paper-made staple 60 in a direction facing each other and bonds the leg portions 61 and 62 to each other. The driver unit 53 and clincher unit 57 face each other across the stacker section 35.

Figure 6:
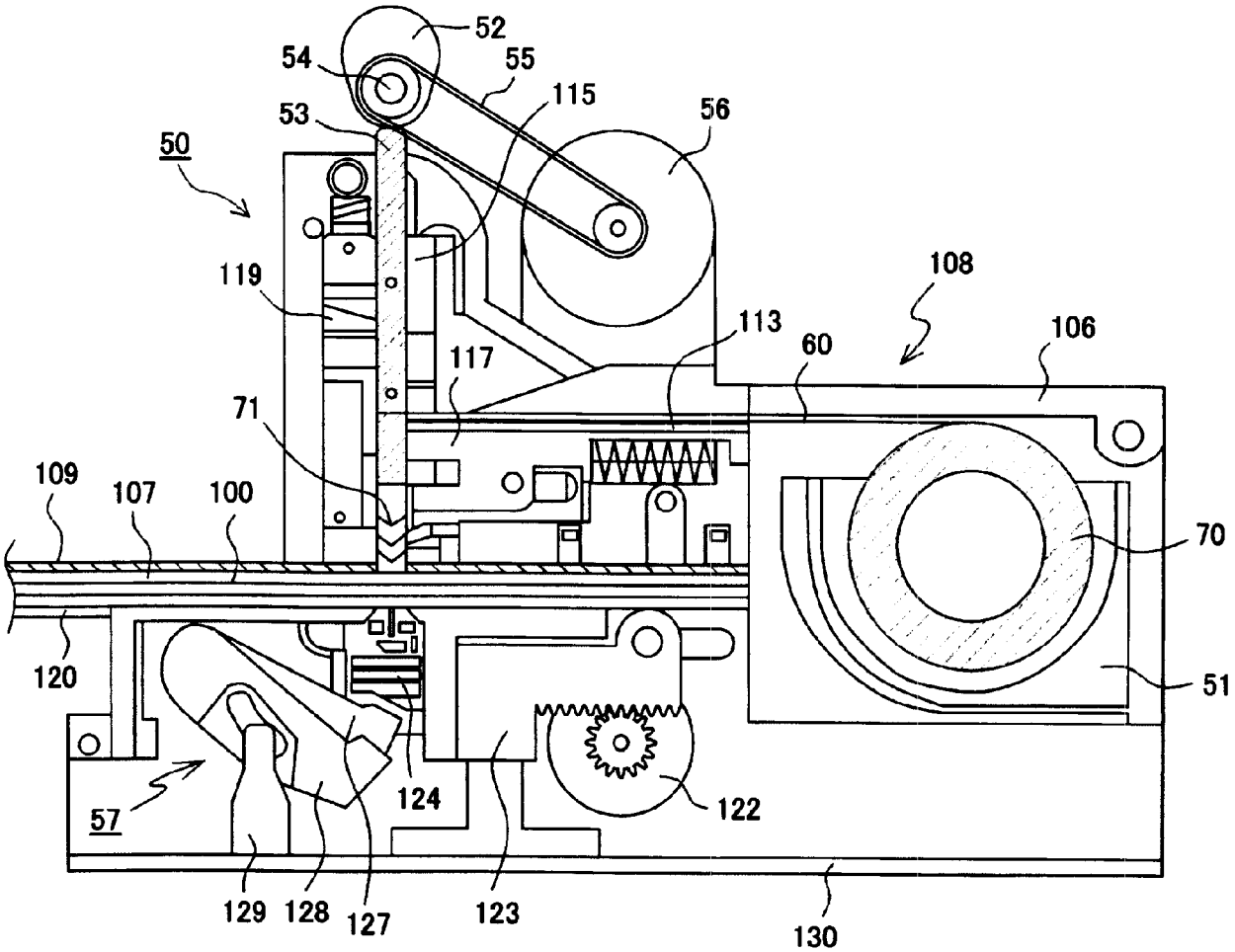
FIG. 6 is an explanatory view illustrating a saddle stitching stapler for paper-made staple (second binding section)

As illustrated in FIG. 6, the saddle stitching stapler 50 for paper-made staple has a frame 108 includes a frame 108 and a base 109. The frame 108 has a sheet insertion port 107 positioned below a drive motor 56 that performs staple drive when the saddle stitching stapler 50 for paper-made staple performs binding operation with the paper-made staple 60, through which paper sheets to be bound are inserted. The base 109 supports the drive motor 56 and frame 108.

As illustrated in FIG. 6, the drive motor 56 is drivably mounted to an upper portion of the frame 108. The drive motor 56 rotates a driver cam 52 when performing the binding operation. When a rolled staple 70 in which a number of paper-made staples 60 are connected is loaded into a staple cartridge 51 (to be described later) of the frame 108, a staple cover 106 positioned to the left of the drive motor 56 is released to open an upper surface of the frame 108.

The frame 108 further has a substantially planar conveying path 113 as a staple conveying path for conveying the paper-made staple 60 frontward from the staple cartridge 51. Although not illustrated, a plate spring is provided on both left and right sides of the conveying path 113.

The frame 108 has, near a front end portion of the conveying path 113, a forming plate 115 as a staple cutting/shaping section for cutting the paper-made staple and shaping it into a substantially U-shape. The forming plate 115 operates with a rotation of the driver cam 52 driven by the drive motor 56. The forming plate 115 performs cutting and shaping of the paper-made staple 60. The frame 108 further has a driver unit 53 as a staple penetrating section for making the paper-made staple 60 penetrate the paper sheets to be bound by the drive of the drive motor 56. The driver unit 53 moves up and down a cutter blade 71 for forming a hole penetrating the paper sheets. The frame 108 further has a sheet presser for pressing the paper sheet to be bound upon cutting, shaping, and penetration of the paper-made staple 60.

The frame 108 further has, below the conveying path 113, a pusher 117 biased frontward by a spring, as a moving mechanism for moving the paper-made staple 60 from a position at which the above-described cutting and shaping of the paper-made staple 60 is performed to a position at which the penetration of the paper-made staple 60 into the paper sheet bundle 100 is performed. There is provided, below the forming plate 115, driver unit 53, sheet presser 119, and pusher 117, a sheet insertion port 107 through which the sheet bundle to be bound and a table 120 on which the sheet bundle to be bound is placed. The table 120 constitutes a part of the stacker section 35.

There is provided, below the table 120, a bending section that bends, along the paper sheet bundle 100, the leg portions 61 and 62 of the driven paper-made staple 60 that has penetrated the paper sheet bundle 100 at the penetration position and bonds the leg portions 61 and 62 to each other. The saddle stitching stapler 50 for paper-made staple has, as the bending section, the clincher unit 57, a pushing unit 124, and a clincher slider 123 and uses a clincher motor 122 to move the pushing unit 124 and clincher slider 123 at an appropriate timing. In the saddle stitching stapler 50 for paper-made staple, there is provided, on a clincher base 130, the clincher unit 42 serving as the bending section and including a clincher lifter 129 that supports and positions a clincher center 127 and a clincher left 128. Details of the mechanism of the paper-made stapler are disclosed in Japanese Patent No. 4,952,129.

The saddle stitching stapler 50 for paper-made staple has the configuration as described above. That is, the driver unit is moved based on operation of the drive motor 56 to bind the paper sheet bundle 100 placed on the table 120 inserted through the sheet insertion port 107. Then, holes are formed so as to penetrate the paper sheet bundle 100, and the paper-made staple 60 is inserted through the holes to bind the paper sheet bundle 100.

In each of the left and right saddle stitching staplers 50 for paper-made staple, the forming plate 115 that forms the paper-made staple 60 into a crown shape and the drive motor 56 that moves the driver unit 53 that drives the paper-made staple 60 into the paper sheet bundle are connected to the driver cam 52 through a transmission belt 55. Thus, the driver cam 52 is rotated by the drive of the drive motor 56 to drive the paper-made staple 60 into the paper sheet bundle 100. At the same time, both the leg portions 61 and 62 are bent inward by the clincher unit 57 and then bonded to each other at an adhesive portion 63 thereof which is coated with an adhesive. The paper-made staple 60 is housed in a staple cartridge 51 of the saddle stitching stapler 50 for paper-made staple and is cut into a size to be driven by the stapler.

The following describes the paper-made staple 60 loaded into the saddle stitching staplers 50 for paper-made staple of the present invention with reference to FIGS. 7 to 14.

[Configuration of Paper-Made Staple]

Figure 7A:
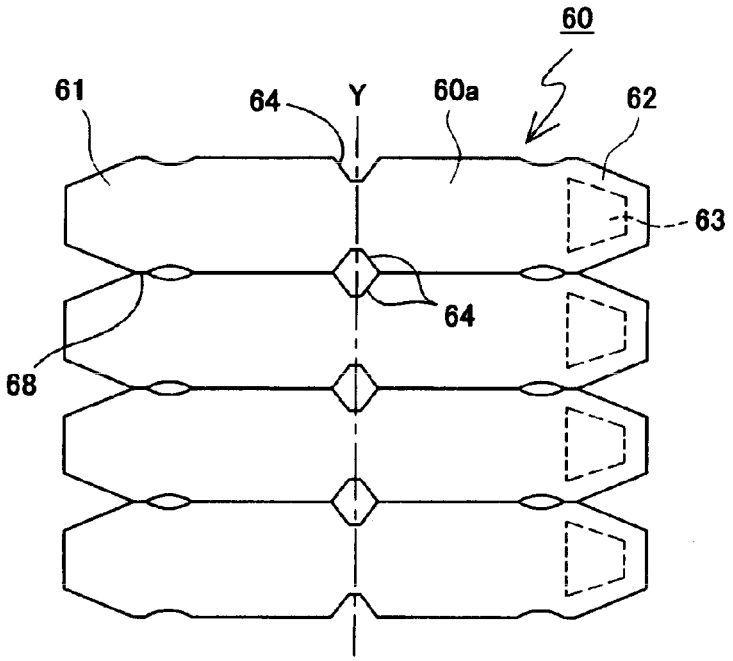
Figure 7B:
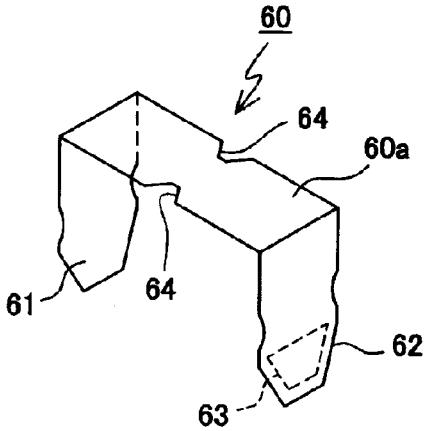
Figure 7C:
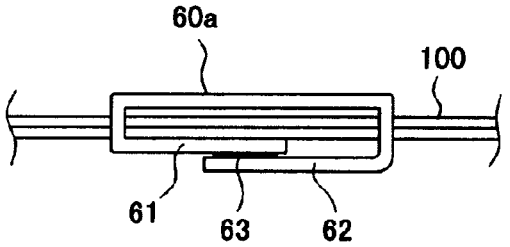

FIGS. 7A to 7C are explanatory views illustrating a configuration which a number of paper-made staples 60 are connected in parallel. More specifically, FIG. 7A is a detailed plan view of the paper-made staple 60. FIG. 7B is a perspective view illustrating a state where the paper-made staple 60 is formed into a substantially U-shape. FIG. 7C is a cross-sectional view illustrating a state where the paper sheet bundle 100 is bound with the paper-made staple 60. The paper-made staple 60 and paper sheet bundle 100 can have the following configurations. The basic configurations thereof are described in detail in Japanese Patent No. 4,952,129.

As illustrated in FIG. 7A, a plurality of the paper-made staples 60 each having an elongated and substantially straight shape are connected in parallel. Each paper-made staple 60 has a width of, e.g., about 6 mm to 12 mm in the up-down direction (connection direction of the paper-made staples 60) of FIG. 7A and a width of, e.g., about 25 mm to 50 mm in the left-right direction (longitudinal direction of the paper-made staple 60) of FIG. 7A. A portion near an end portion of each paper-made staple 60 in the longitudinal direction is formed into a trapezoidal shape, and a width thereof become smaller toward its leading end. Each paper-made staple 60 has, on a rear surface thereof near an end portion in the longitudinal direction, an adhesive portion 63 coated with an adhesive.

Further, elliptic feed holes are formed at positions spaced apart by a predetermined distance from both end portions of sides of the adjacent two paper-made staples 60. A portion between the two feed holes serves as a slit portion, whereby the paper-made staples 60 are completely separated from one another. A portion from an outside end of the feed hole to an end portion of the side connected to the adjacent paper-made staple 60 serves as a connection portion 68 through which the paper-made staples 60 are connected. A feed pawl on the stapler side is engaged with the two feed holes feed pawl, thereby gradually feeding the paper-made staples 60.

The paper-made staple 60 has a folding position slit 64 obtained by cutting inward a substantial center position of the staple leg portion connection portion 60*a* connecting the leg portions in the longitudinal direction of the staple. The folding position slit 64 is formed for easy and reliable folding of the paper-made staple 60 together with the paper sheet bundle 100 in the folding processing to be described later.

The individual paper-made staple 60 is separated from the connected-state staples illustrated in FIG. 7A by the saddle stitching stapler 50 for paper-made staple, and then, as illustrated in FIG. 7B, formed into a substantially U-shape defined by the staple leg portion connection portion 60*a* and leg portions 61 and 62 bent at left and right ends of the staple leg portion connection portion 60*a* at substantially right angles. Then, as illustrated in FIG. 7C, in the paper-made staple 60 formed into the substantially U-shape, both the staple leg portions 61 and 62 penetrating the paper sheet bundle 100 are bent along the paper sheet bundle 100, and one leg portion 61 and the other leg portion 62 having the adhesive portion 63 are bonded to each other. Then, when the paper sheet bundle 100 is folded with the leg portion side inside in a state where the paper sheet bundle 100 is bound with the paper-made staple 60, the paper-made staple 60 can easily be folded since the folding position slit 64 is formed in the substantial center portion of the staple leg portion connection portion 60*a* connecting the leg portions 61 and 62.

The paper-made staple 60 illustrated in FIGS. 7A to 7C has the adhesive portion 63 on the rear surface of one leg portion 62 in the longitudinal direction; however, the adhesive portion 63 may be provided on rear surfaces of both leg portions 61 and 62. In this case, not only the leg portions 61 and 62 are bonded to each other, but also the leg portion 61 is bonded to a rear surface of the paper sheet bundle, thereby increasing the bonding strength. Also in this paper-made staple 60, the folding position slit 64 is formed in the staple leg portion connection portion 60*a*, so that the paper-made staple 60 can reliably be folded. As illustrated in FIG. 6, the paper-made staples 60 are wound in a roll shape (rolled staple 70) and housed in the saddle stitching staplers 50 for paper-made staple.

[Sheet Binding Using Paper-Made Staple]

Figure 8A:
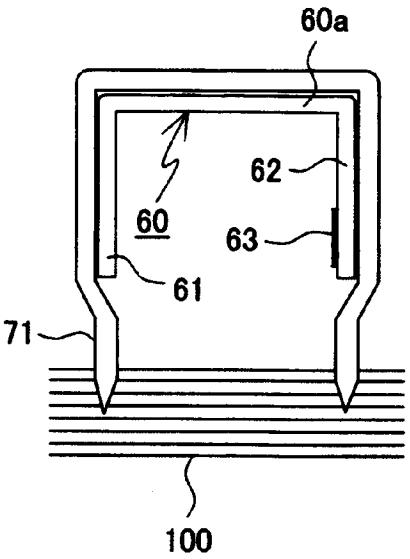
Figure 8B:
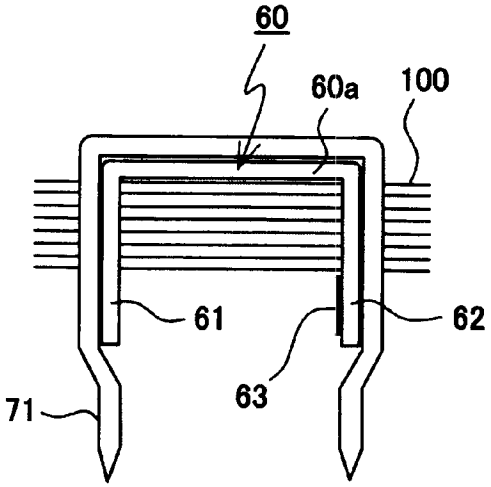
Figure 8C:
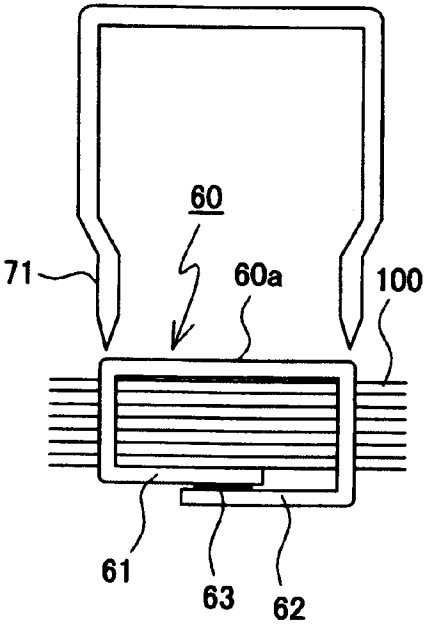

FIGS. 8A to 8C are views each illustrating the cutter blade 71 provided at a leading end of the driver unit 53 illustrated in FIG. 6 and configured to allow the paper-made staple 60 to penetrate the paper sheet bundle 100 and its operation. FIG. 8A illustrates a state where the paper-made staple 60 formed into the U-shape by the forming plate 115 is set to the cutter blade 71 by the pusher 117. When the driver unit 53 moves down in a state where the paper-made staple 60 is set to the cutter blade 71, the cutter blade 71 is inserted into the paper sheet bundle 100 while retaining the paper-made staple 60, as illustrated in FIG. 8B. Thereafter, the leg portions 61 and 62 of the paper-made staple 60 are bent inward and bonded to each other by the pushing unit 124 and clincher 42. Synchronously with this operation, the driver unit 53 moves upward, and the paper sheet bundle 100 is bound by the paper-made staple 60. The cutter blade 71 returns to its original position as illustrated in FIG. 8C and waits for next paper-made staple 60. In this manner, the paper sheet bundle 100 is bound.

[Paper Sheet Bundle Bound by Saddle Stitching Stapler for Paper-Made Staple]

Figure 9:
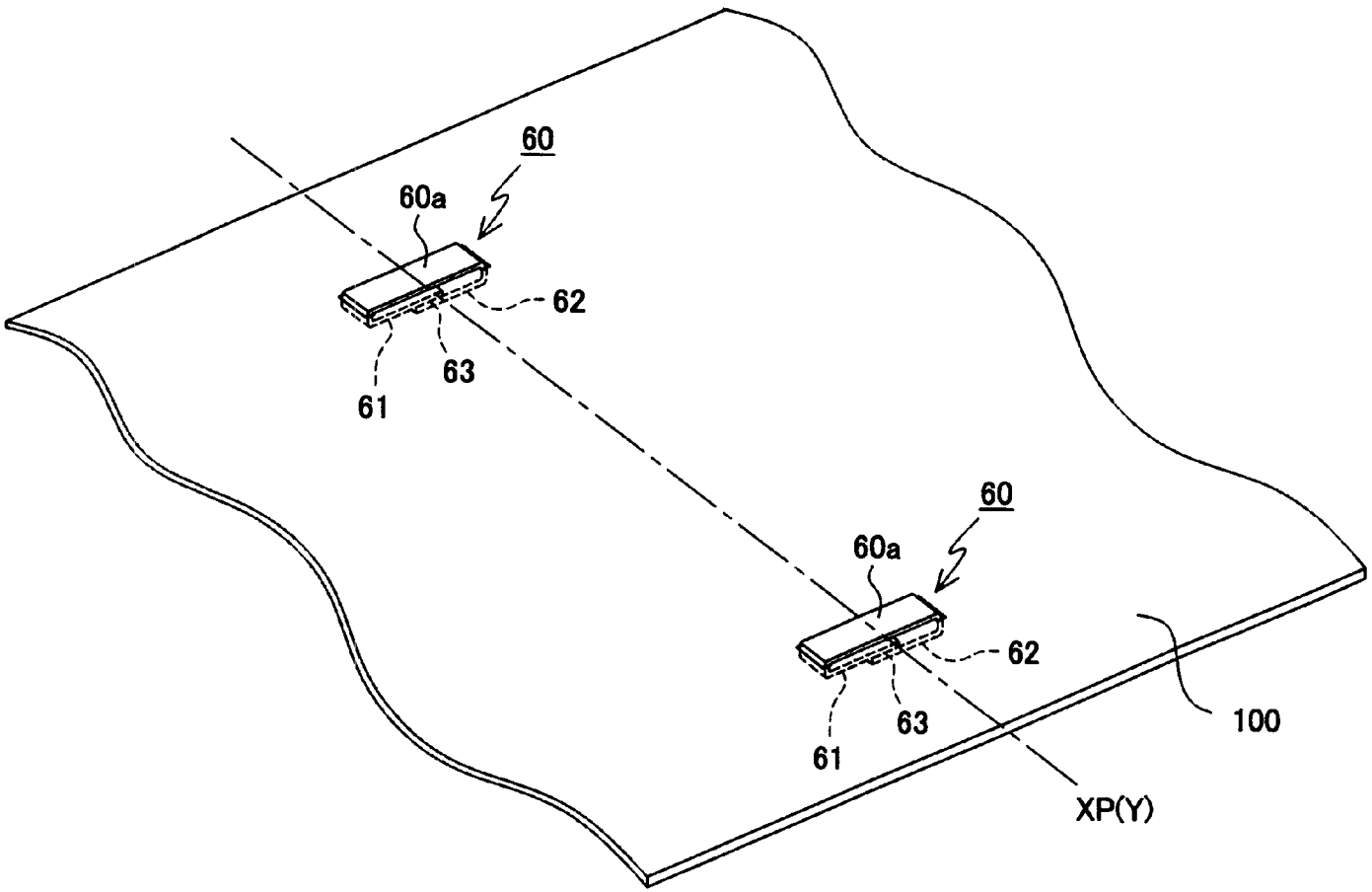
FIG. 9 is an explanatory view illustrating a state where the paper sheet bundle is bound by the saddle stitching stapler of FIG. 6 with the paper-made staple straddling the folding position of the paper sheet bundle.

FIG. 9 illustrates a state where the saddle stitching stapler 50 for paper-made staple is used to saddle stitch the paper sheet bundle at the center thereof in the conveying direction. In FIG. 9, the staple leg portion connection portion 60*a* which is the back part of the paper-made staple is illustrated. As illustrated in FIG. 9, the back part (staple leg portion connection portion 60*a*) of the paper-made staple 60 is positioned so as to straddle the folding line of the folding position in a direction crossing the same. Thus, the paper-made staple 60 can be pushed between the folding rollers 45*a* and 45*b* by the folding blade 46 to be described below.

The position of the paper sheet bundle 100 is set by the movement of the stopper 38 such that the paper-made staple 60 straddles the folding position in the sheet conveying direction. In FIG. 9, the leg portions 61 and 62 of the left and right paper-made staples 60 are driven, sandwiching the folding position Y therebetween such that the staple leg portion connection portion 60*a* of the leg portions 61 and 62 is directed along the sheet conveying direction with a center thereof substantially coincides with the folding position Y. With this configuration, the staple leg portion connection portion 60*a* of the paper-made staple 60 is easily folded with the leg portions 61 and 62 inside upon folding of the paper sheet bundle.

[Folding Processing of Paper Sheet Bundle Bound by Paper-Made Staple]

The following describes folding processing of the paper sheet bundle 100 saddle stitched by the saddle stitching stapler 50 for paper-made staple with reference to FIG. 10. The folding processing performed by the saddle stitching stapler 50 for paper-made staple is substantially the same as that folding processing performed by the saddle stitching stapler 40 for metallic staple, so that detailed descriptions thereof are omitted, and only a different point will be described.

Figure 10A:
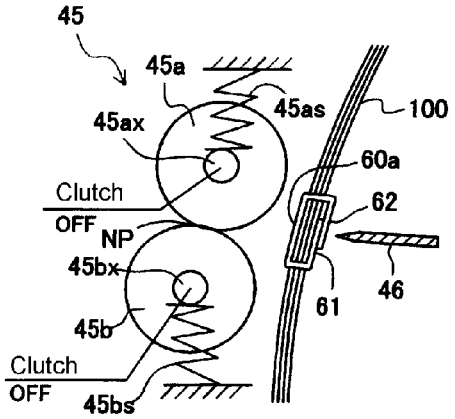
Figure 10B:
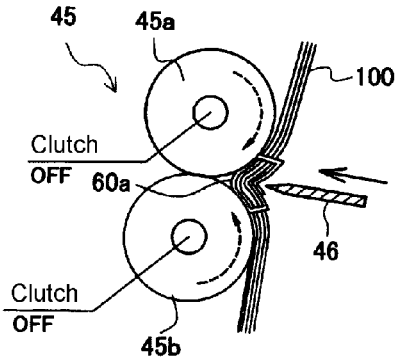
Figure 10C:
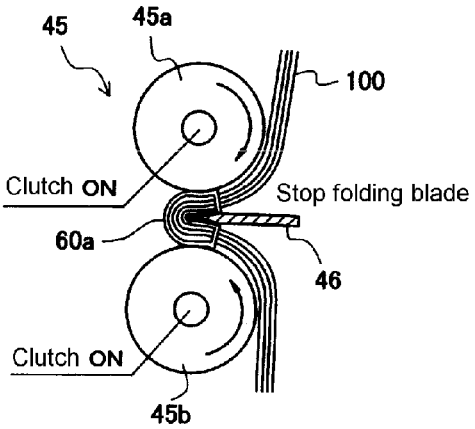
Figure 10D:
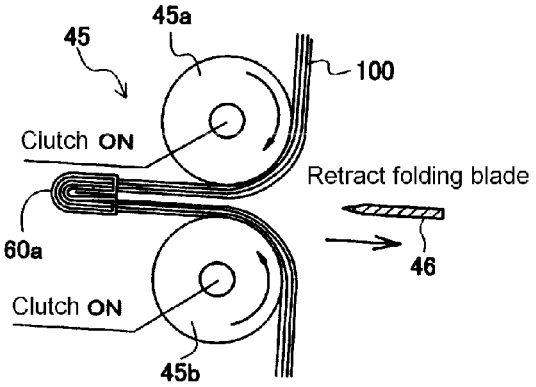

That is, the rear part of the metallic staple 40*a* is directed in parallel to the folding line of the folding position Y; on the other hand, the paper-made staple 60 straddles the folding line of the folding position Y, and the rear part thereof is directed in a direction crossing the folding line of the folding position Y. Thus, as illustrated in FIG. 10A, the leg portions 61 and 62 of the paper-made staple 60 are pushed by the folding blade 46. This can increase bonding strength between the leg portions. Further, since the staple leg portion connection portion 60*a* crosses the folding line of the folding position Y, the paper-made staple 60 can be folded together with the paper sheet bundle, as illustrated in FIGS. 10C and 10D, which is a different point from the folding processing of the paper sheet bundle bound by the metallic staple 40*a* illustrated in FIGS. 5A to 5D.

[Arrangement of Saddle Stitching Stapler for Metallic Staple and Saddle Stitching Stapler for Paper-Made Staple]

Figure 11:
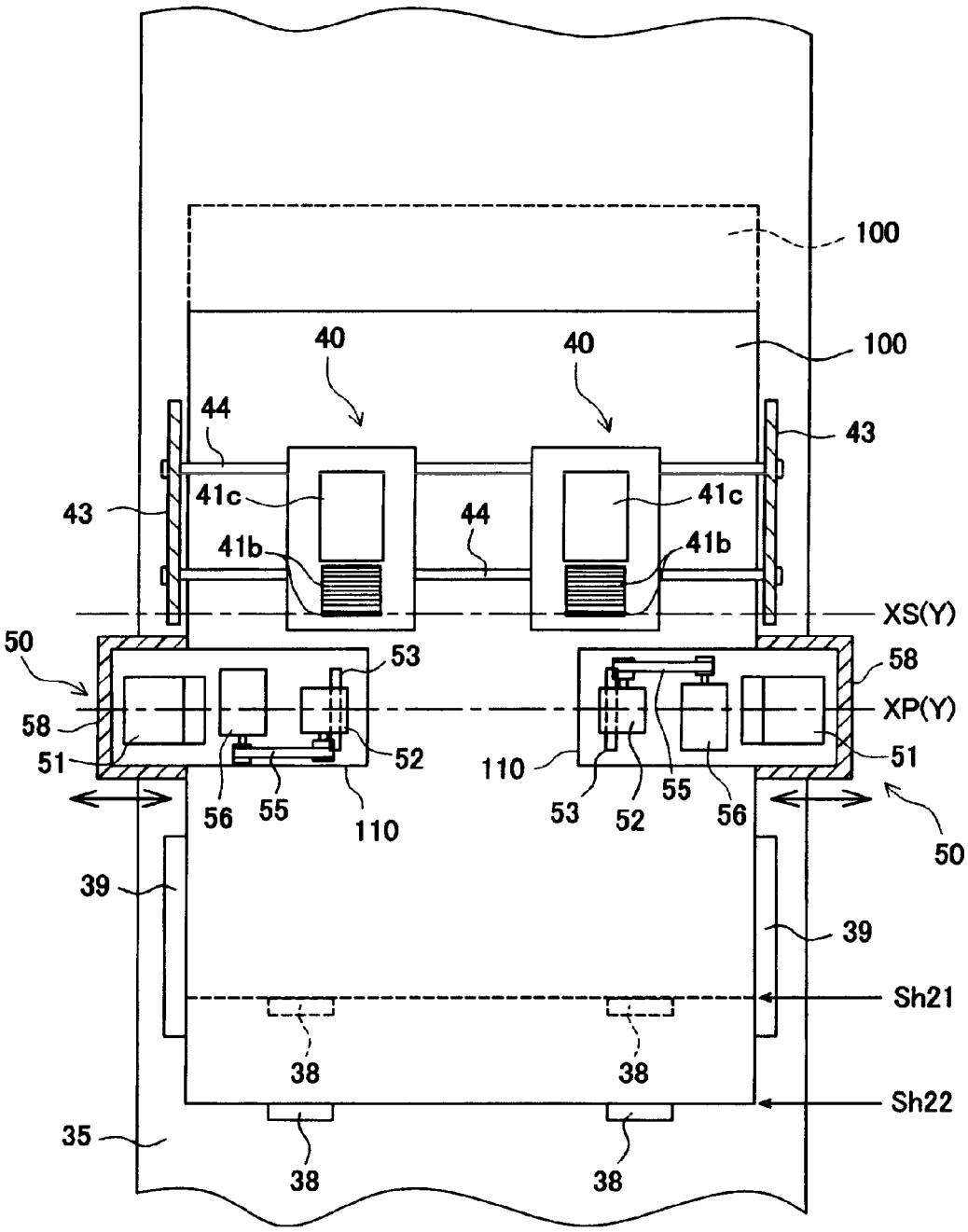
FIG. 11 is a plan view illustrating the saddle stitching stapler for metallic staple (first binding section) and saddle stitching stapler for paper-made staple (second binding section) disposed in the stacker section.

The following describes arrangement of the saddle stitching stapler 50 for paper-made staple and saddle stitching stapler 40 for metallic staple in the stacker section 35 with reference to FIG. 11. FIG. 11 is a plan view, as viewed from the paper sheet bundle discharge side, illustrating a state where the saddle stitching stapler 40 for metallic staple and saddle stitching stapler 50 for paper-made staple are disposed in this order toward the folding roller 45 of FIG. 2.

The saddle stitching stapler 40 for metallic staple described in detail using FIGS. 3A and 3B, more specifically, left and right saddle stitching staplers 40 for metallic staple are fixedly disposed to the stapler support rods 44 crossed between left and right saddle stitching carriage 43 provided in the stacker section 35. The left and right saddle stitching staplers 40 for metallic staple are each configured to be movable on the stapler support rods 44 so as to be adjusted in left-right direction position. As can be seen from FIG. 11, the head member 41*a* is directed in the same direction as the extending direction of the folding line of the folding position Y.

The saddle stitching stapler 50 for paper-made staple, more specifically, left and right saddle stitching staplers 50 for paper-made staple positioned below are supported by left and right saddle stitching carriages 58 provided in the stacker section 35. The left and right saddle stitching stapler 50 for paper-made staple are each also configured to be movable on the saddle stitching carriage 58 so as to be adjusted in left-right direction position. As can be seen from FIG. 11, the driver unit 53 is directed in a direction crossing the folding line of the folding position Y of the paper sheet bundle and, thereby, the leg portions 61 and 62 of the paper-made staple are driven into the paper sheet bundle so as to straddle the folding line of the folding position Y.

As already described, the stopper 38 is positioned on the downstream side of the saddle stitching stapler 50 for paper-made staple. The position Sh22 (continuous line of FIG. 11) of the stopper 38 corresponds to the binding position XP of the saddle stitching stapler 50 for paper-made staple. The position Sh21 (dashed line) of the stopper 38 corresponds to the binding position XS of the saddle stitching stapler 40 for metallic staple. The paper sheet bundle is thus bound at the bounding position and then moved to the folding position to be folded.

A reference numeral 39 denotes an aligning member that presses both side edges of the paper sheets every time the paper sheet is carried in the stacker section 35 so as to align the paper sheets. The aligning member 39 is connected to a not-illustrated aligning motor.

Other Embodiments

Figure 13:
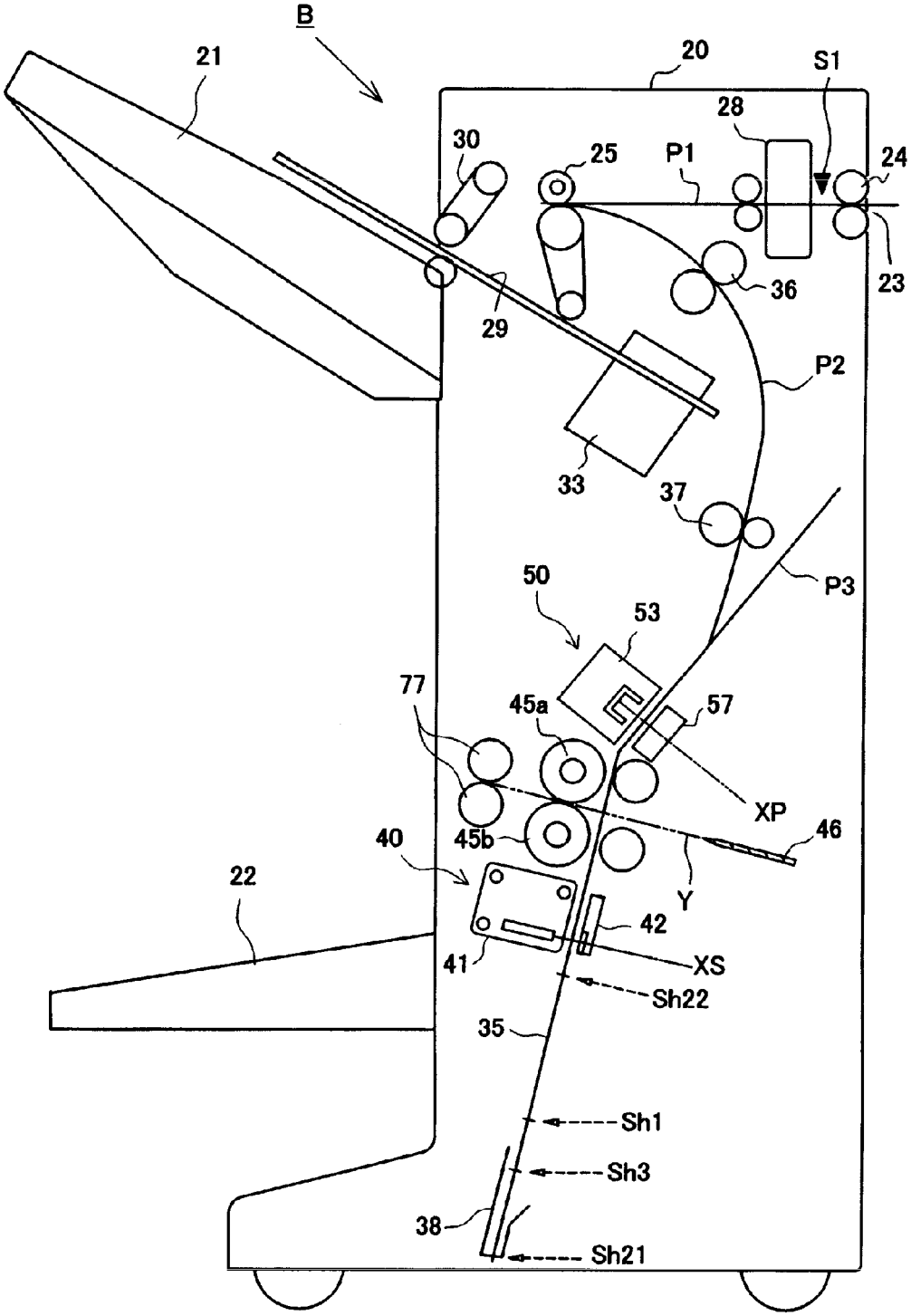
FIG. 13 is an explanatory view illustrating a third embodiment in which the saddle stitching stapler for paper-made staple (second binding section) is disposed on the upstream side of the folding section in the sheet conveying direction, and saddle stitching stapler for metallic staple (first binding section) is disposed on the downstream side.
Figure 14:
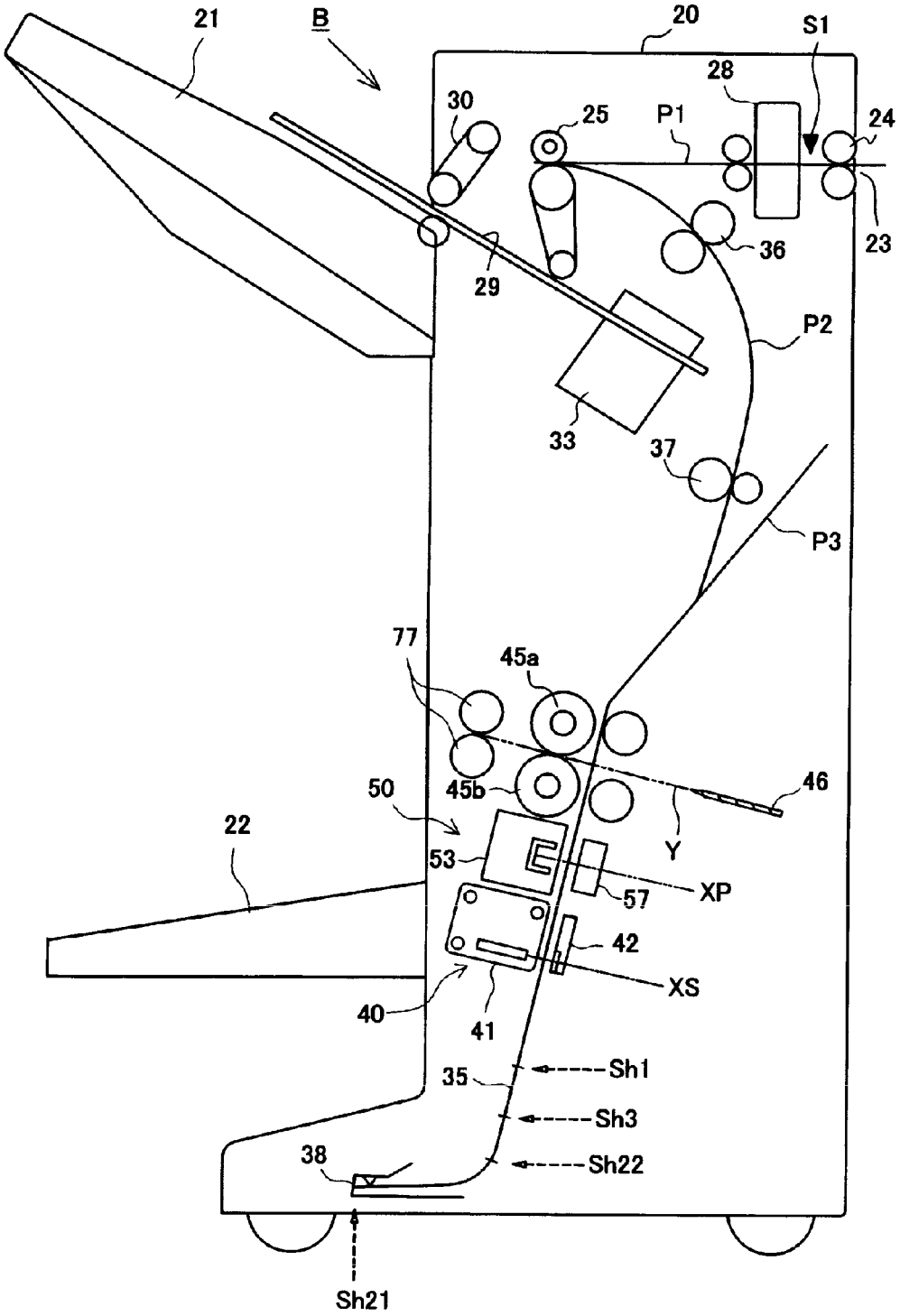
FIG. 14 is an explanatory view illustrating a fourth embodiment in which the saddle stitching stapler for paper-made staple (second binding section) is disposed on the downstream side of the folding section in the sheet conveying direction, and saddle stitching stapler for metallic staple (first binding section) is disposed on the downstream side of the saddle stitching stapler for paper-made staple.

Thus far, the image forming device of a type illustrated in FIG. 2 has been described as the first embodiment, in which the left and right saddle stitching staplers 40 for metallic staple illustrated in FIGS. 3A and 3B are arranged side by side in a direction crossing the sheet conveying direction at a position on the upstream side of the folding roller 45 and folding blade 46 and the left and right saddle stitching stapler 50 for paper-made staple illustrated in FIG. 6 are disposed below the saddle stitching stapler 40 for metallic staple. In this configuration, the saddle stitching stapler 50 for paper-made staple is disposed closer to the folding roller 45 and folding blade 46 to thereby prevent the paper-made staple to come off from the paper sheet bundle 100. However, the image forming device may have configurations as illustrated in FIGS. 12 to 14 and can obtain effects to be described later.

Second Embodiment

Figure 12:
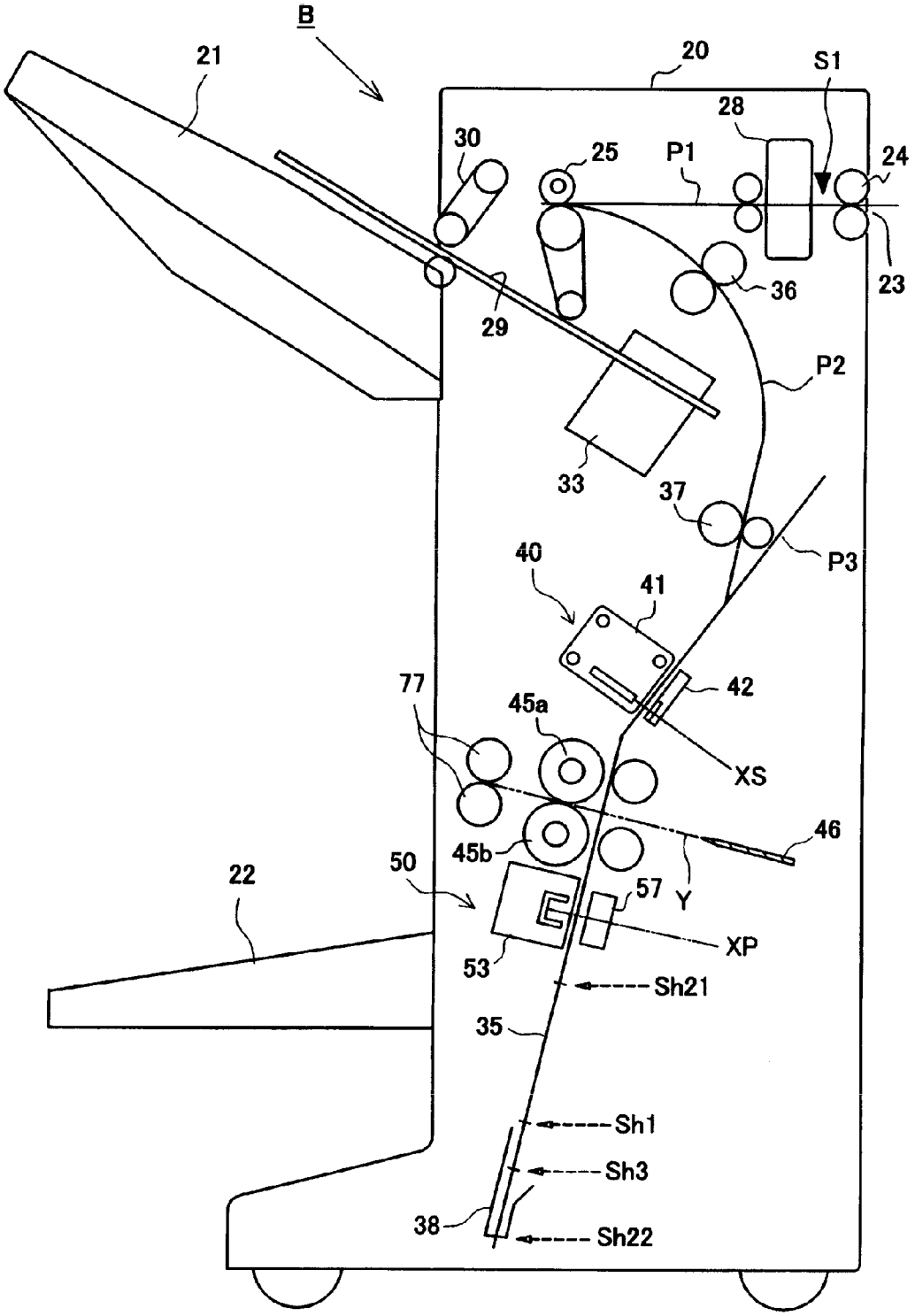
FIG. 12 is an explanatory view illustrating a second embodiment in which the saddle stitching stapler for metallic staple (first binding section) is disposed on the upstream side of the folding section in the sheet conveying direction, and saddle stitching stapler for paper-made staple (second binding section) is disposed on the downstream side.

As illustrated in FIG. 12, in a second embodiment, the left and right saddle stitching staplers 40 for metallic staple illustrated in FIGS. 3A and 3B are disposed on the upstream side of the folding roller 45 and folding blade 46, and left and right saddle stitching staplers 50 for paper-made staple illustrated in FIG. 6 are disposed on the downstream side of the folding roller 45 and folding blade 46. With this configuration, both the saddle stitching staplers 50 for paper-made staple and saddle stitching staplers 40 for metallic staple can be disposed closer to the folding roller 45 and folding blade 46 than in the case where the stapler 50 and stapler 40 are continuously installed on one side of the folding roller 45 and folding blade 46. Further, by disposing the stapler 50 and stapler 40 on both sides of the folding roller 45 and folding blade 46, respectively, it is possible to effectively use a space of the stacker section 35. Further, by disposing the saddle stitching stapler 50 for paper-made staple closer to the folding roller 45 and folding blade 46 than the saddle stitching stapler 40 for metallic staple, it is possible to suppress the paper-made staple 60 from coming off from the paper sheet bundle. The stop positions of the stopper 38 for stopping the paper sheet bundle 100 are as illustrated in FIG. 12.

Third Embodiment

As illustrated in FIG. 13, in a third embodiment, the left and right saddle stitching staplers 50 for paper-made staple illustrated in FIG. 6 are disposed on the upstream side of the folding roller 45 and folding blade 46, and left and right saddle stitching staplers 40 for metallic staple illustrated in FIGS. 3A and 3B are disposed on the downstream side of the folding roller 45 and folding blade 46. With this configuration, the same effects as those in the second embodiment can be obtained. Further, in the third embodiment, the saddle stitching staplers 40 for metallic staple are disposed on the downstream side of the folding roller 45 and folding blade 46, so that even if the metallic staple 40*a* drops due to blank drive of the stapler, it does not go into the saddle stitching stapler 50 for paper-made staple or folding roller 45 side. The stop positions of the stopper 38 for stopping the paper sheet bundle 100 are as illustrated in FIG. 13.

Fourth Embodiment

As illustrated in FIG. 14, in a fourth embodiment, the left and right saddle stitching staplers 40 for metallic staple illustrated in FIGS. 3A and 3B and left and right saddle stitching staplers 50 for paper-made staple illustrated in FIG. 6 are disposed on the downstream side of the folding roller 45 and folding blade 46. Further, the saddle stitching staplers 50 for paper-made staple are disposed closer to the folding roller 45 and folding blade than the saddle stitching staplers 40 for metallic staple. Also with this configuration, it is possible to suppress the paper-made staple 60 with a low tolerance to resistance from coming off from the paper sheet bundle 100. Further, the saddle stitching staplers 40 for metallic staple are disposed on the downstream side of the folding roller 45 and folding blade 46, so that even if the metallic staple 40*a* drops due to blank drive of the stapler, it does not go into the saddle stitching stapler 50 for paper-made staple or folding roller 45 side. The stop positions of the stopper 38 for stopping the paper sheet bundle 100 are as illustrated in FIG. 14.

Figure 15A:
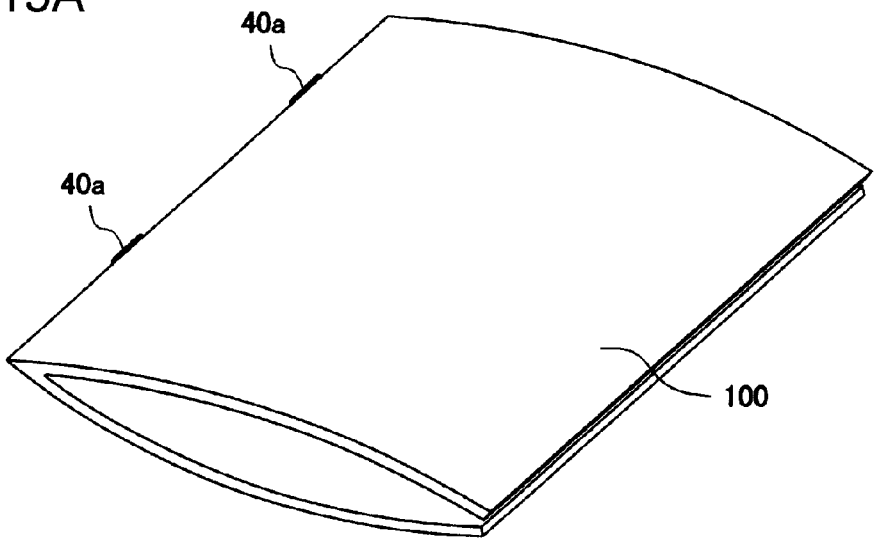
Figure 15B:
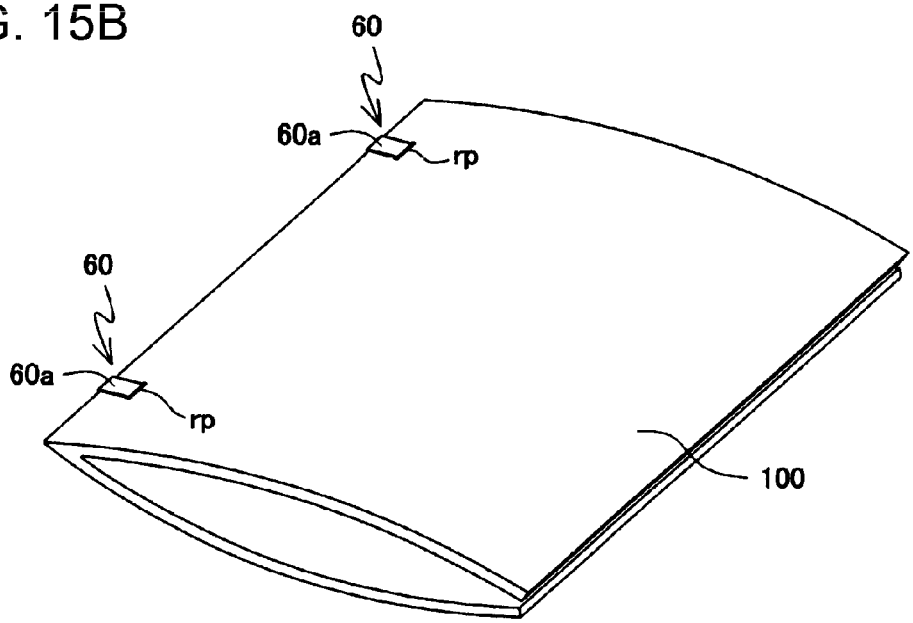

Thus far, some embodiments of the present invention have been described, and the paper sheet bundle that has been subjected to saddle stitching and folding processing is illustrated in FIGS. 15A and 15B. FIG. 15A illustrates a paper sheet bundle saddle stitched with the metallic staple 40*a* and then folded in the center, and FIG. 15B illustrates a paper sheet bundle saddle stitched with the paper-made staple 60 and then folded in the center. The paper sheet bundle bound with the paper-made staple 60 does not include a metallic member at all, so that it is possible to eliminate the need of separating the staple from the paper sheet bundle in disposal, which is advantageous in terms of environmental protection. Further, use of the metallic staple 40*a* allows high-speed binding operation. Thus, according to the present invention, two types of the saddle stitching staplers are compactly implemented in a finisher as one sheet processing device.

[Binding by Paper-Made Staple Using Punch Holes]

In the present embodiments, the paper-made staple 60 can be driven, by the saddle stitching stapler 50 for paper-made staple, into punch holes punched by the punch unit 28 provided near the carry-in port illustrated in FIG. 2 and FIGS. 12 to 14 to bind the paper sheet bundle, that is, a simple ring type binding can be conducted.

Figure 16:
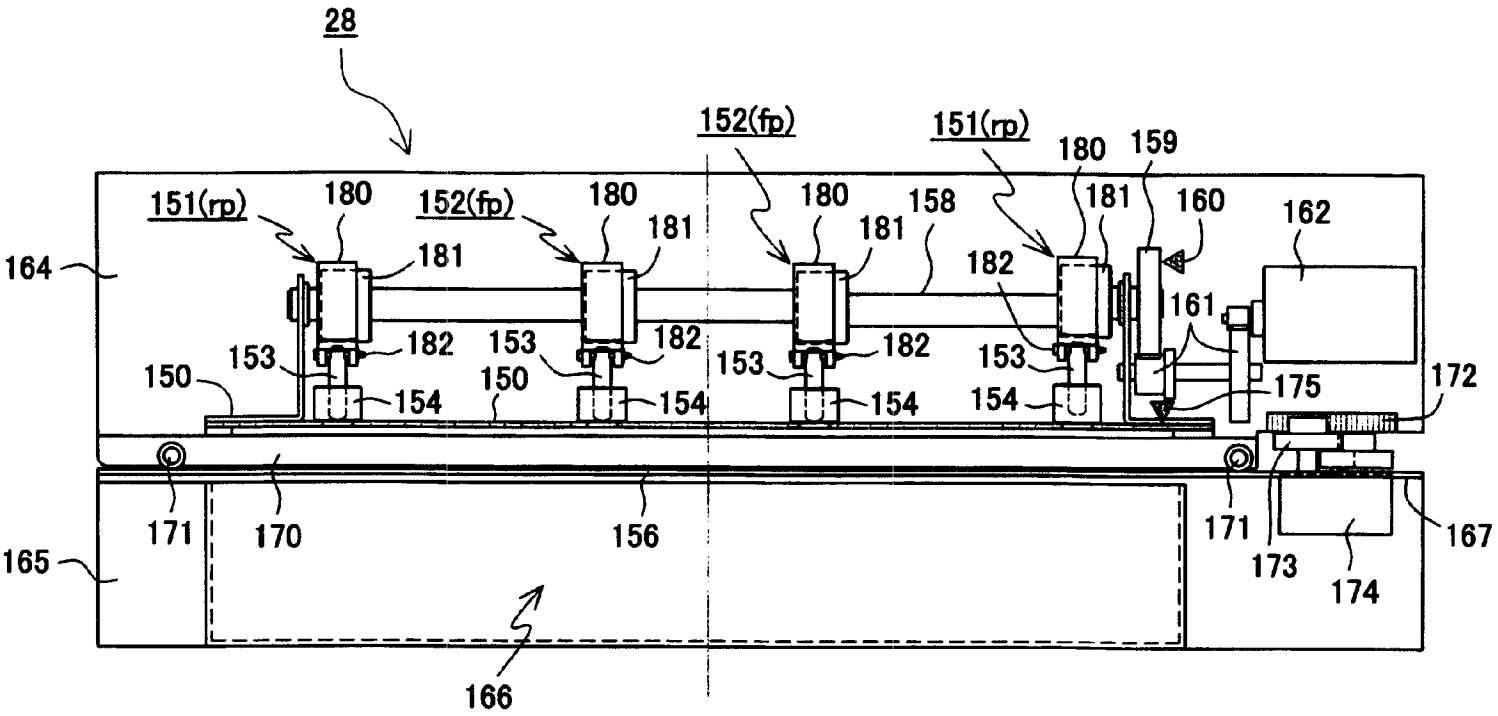
FIG. 16 is a cross-sectional view of a mechanism of a single-sheet punch unit illustrated in FIGS. 2 and 3A, 3B.
Figure 17:
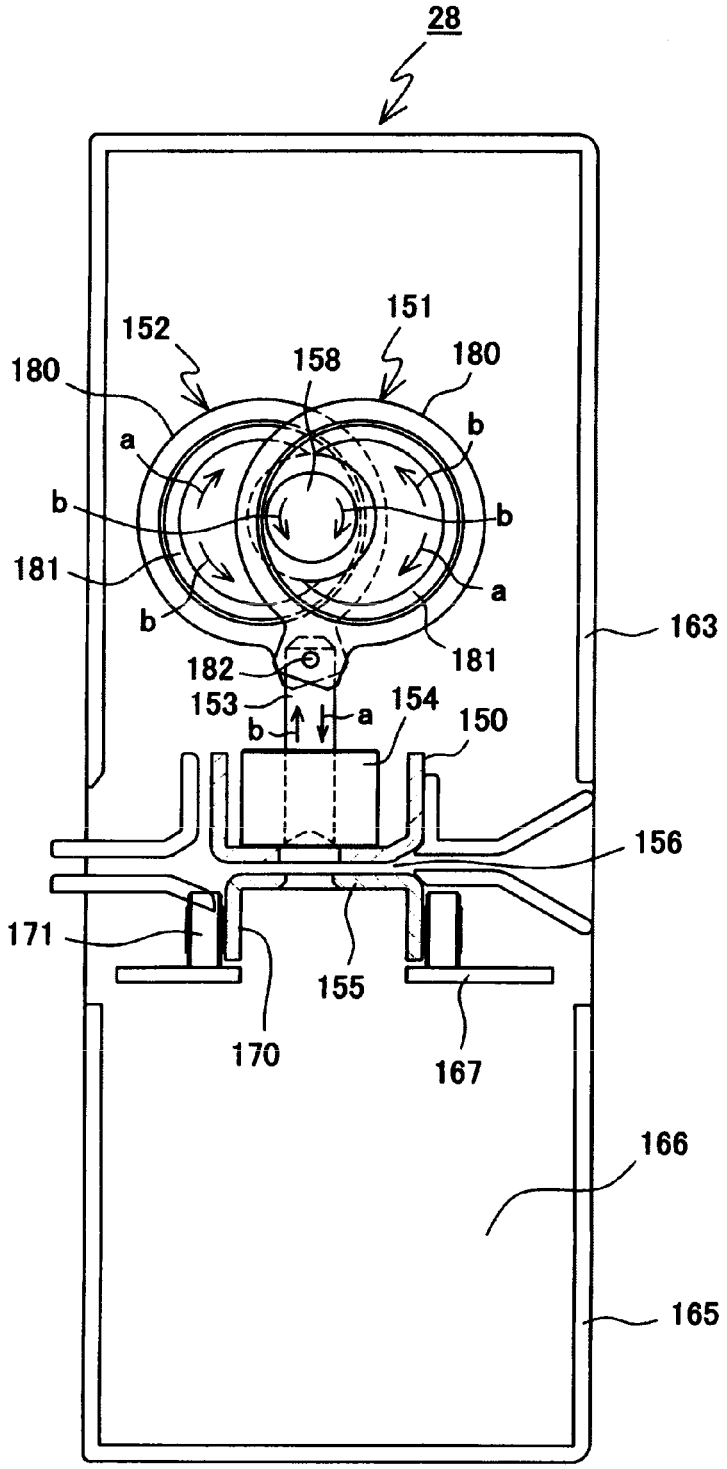
FIG. 17 is a cross-sectional view of the single-sheet punch unit of FIG. 16.

FIGS. 16 and 17 are explanatory views each illustrating the single-sheet punch unit 28. As illustrated in FIG. 16, in a casing (an upper guide 164 and a lower guide 165) of the single-sheet punch unit 28, a punch motor 162 serving as a drive source for punch units 151 and 152 is provided. A drive from the punch motor 162 is input to a drive shaft 158 through a gear train 161 and an entrance gear 159.

The punch units 151 and 152 each punching holes at predetermined positions of the paper sheet are mounted to the drive shaft 158. The punch unit 152 is a unit that punches filing holes fp at a position around a width direction center of the paper sheet. The punch unit 151 punches, at a position near a sheet side edge, simple ring holes rp that the already described paper-made staple 60 is made to penetrate. Thus, in order to make the paper-made staple 60 penetrate the paper sheet bundle for the simple binding, the ring punch unit 151 is activated; on the other hand, in order to punch the filing holes, the filing punch unit 152 is activated. Accordingly, for punching both the ring holes and filing holes, both the punch units 151 and 152 are activated.

As illustrated in detail in FIG. 17, the punch units 151 and 152 differ from each other only in terms of a phase of a rotating cam, and other configurations thereof are the same. In FIG. 17, the ring punch unit 151 for punching the simple ring holes rp is disposed on the near side of the figure, and the filing punch unit 152 for punching the filing holes fp is disposed on the far side.

There are mounted, to each of the punch units 151 and 152, an eccentric cam 181 rotated by rotation of the drive shaft 158 and a cam holder 180 driven into rotation at an outside of the eccentric cam 181. A punch blade 153 that punches the punch hole in the paper sheet is axially supported by a punch blade mounting pin 182 at a lower end portion of the cam holder 180. Up-down movement of the punch blade 153 is guided by a punch blade guide 154 mounted to an upper frame 150 constituting a part of a frame of the single-sheet punch unit 28. A punch die 155 that the punch blade 153 penetrates is disposed below the upper frame 150 so as to face the upper frame 150 across a sheet conveying path (P1) 156.

The upper frame 150 that supports the punch blade guide 154 and the like and a punch lower frame 170 having the die and the like can be moved together in the left-right direction of FIG. 16 by rollers 171 provided on a punch support frame 167. This movement is made by a rack 172 provided on the right side of the upper guide 164 in FIG. 16 and a gear 173 engaged with the rack 172. The rack 172 is moved by a movement motor 174 through the gear 173. Along with this movement, the upper guide 164 including the punch units 151, 152, and punch blade 154 and punch lower frame 170 including the punch die 155 are slid, by the rollers, in the left-right direction on the punch support frame 167 provided in the lower guide 165.

This sliding movement is performed as follows. The upper guide 164 including the punch units 151, 152, punch die 155, and the like is positioned at a home position which is the rightmost position in FIG. 16. After the paper sheet is carried in the sheet conveying path (P1) 156, the movement motor 174 fixed to the lower guide 165 is driven. Then, the gear 173 is rotated to move the rack 172 leftward in the figure. When a sensor 175 detects a side edge of the paper sheet being conveyed, the drive of the movement motor 174 is stopped. This allows desired punch holes to be punched at the same position with respect to all the conveyed paper sheets even if there is a slight variation in a width direction position of the paper sheet. In the lower guide 165, a punch chip box 166 for housing punch chips generated by the punch processing of the punch blade 153 is provided below the punch units 151 and 152, as illustrated in FIG. 16.

[Operation of Single-Sheet Punch Unit 28]

The single-sheet punch unit 28 configured in the above-mentioned operates as follows. When the paper sheet conveyed by the conveying roller 24 is detected by a sensor S1, it is determined that the detected portion is the sheet end edge or sheet center in the sheet conveying direction. When the detected portion is the sheet center, the single-sheet punch unit 28 operates according to a punch position specification (filing holes fp, or simple ring holes rp that the paper-made staple is made to penetrate, or both the filing holes fp and simple ring holes rp).

It is assumed here that both the filing holes fp and simple ring holes rp are punched. As illustrated in detail in FIG. 18, a sheet conveying direction position 1/2L of the sheet length information is a center of the paper sheet in the conveying direction. This center position corresponds to the folding position Y of the paper sheet bundle and the position that the paper-made staple 60 is made to straddle. Thus, the filing holes fp and simple ring holes rp are each punched at the front and rear of the folding position in the sheet conveying direction.

When the center of the paper sheet detected by the sensor SE1 reaches a position in the front of the center line 1/2L by β, conveying operation by the carry-in roller 24 and sheet discharge roller 25 is once stopped. In the course of this conveying, the upper guide that supports the punch units 151 and 152 activates the movement motor 174 from when it starts moving from the home position which is the rightmost position of FIG. 16 until a sensor 175 for detecting the sheet side edge detects the sheet side edge to set the filing holes fp with reference to the sheet side edge. Then, after the movement motor 174 is stopped, punch processing is executed.

In the punch processing, the punch motor 162 is rotated by 90 degrees in the clockwise direction in FIG. 17. This rotation angle is determined by detecting a pulse generation flag attached to the entrance gear of the drive shaft 158 using an encoder sensor 160. When the drive shaft 158 is rotated in the counterclockwise direction in the figure, the eccentric cam 181 is also rotated in the counterclockwise direction. The rotation of the eccentric cam 181 causes the punch blade 153 of the ring punch unit 151 to move upward as indicated by an arrow b. On the other hand, the eccentric cam 181 of the filing punch unit 152 has a difference phase from that of the eccentric cam 181 of the ring punch unit 151, so that it moves down to punch the filing holes fp. After punching of the filing holes fp, the punch motor 162 is reversed. At the same time, the carry-in roller 24 and sheet discharge roller 25 are driven into rotation once again to further convey the paper sheet and stops the paper sheet when a difference from the center line 1/2L becomes α. In this state, when the punch motor is further rotated in the clockwise direction in FIG. 17, the punch blade 153 of the ring punch unit 151 moves in a direction indicated by an arrow a in the figure and punches, in the paper sheet, the ring holes rp that the leg portions 61 and 62 of the paper-made staple penetrate.

After punching of the filing holes fp and simple ring holes rp on the upstream side, the paper sheet is once again moved beyond the center line 1/2L. This time, the simple ring holes r'p and filing holes f'p on the downstream side are punched. As a result, eight punch holes (four on the upstream side, and four on the downstream side) are punched across the center line 1/2L of the conveyed paper sheet, as illustrated in FIG.

18. After completion of the punch processing, the paper sheet that has been subjected to the punch processing is temporarily stored in the stacker section 35 as described above and then subjected to the folding processing by the saddle stitching staplers 50 for paper-made staple, folding roller 45, and folding blade 46 to be stored in the second sheet discharge tray.

Figure 19:
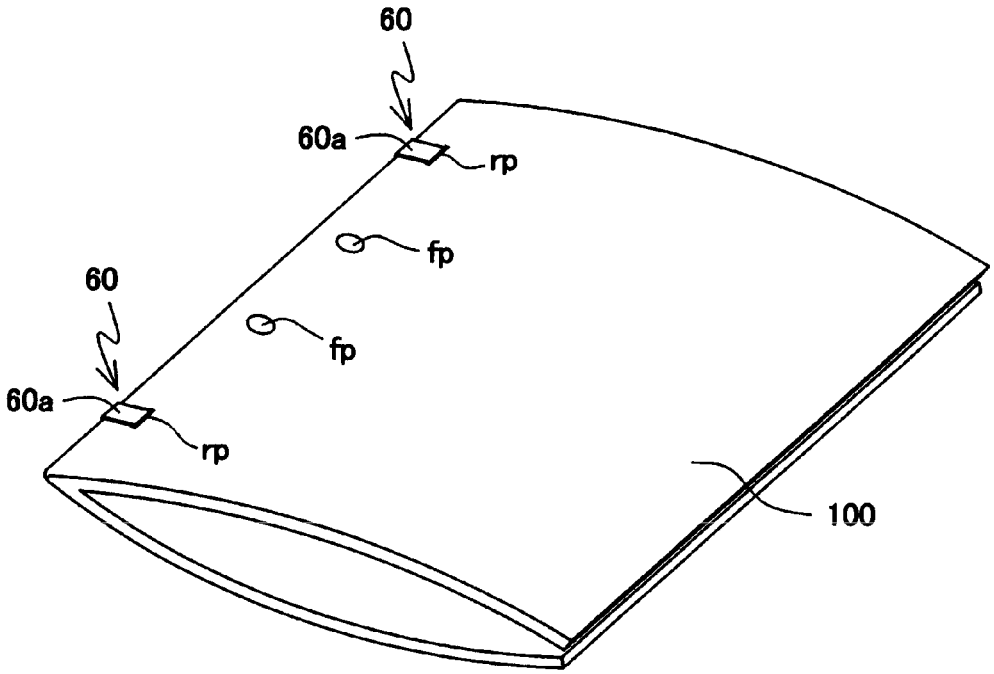
FIG. 19 is an explanatory view of a paper sheet bundle that has been subjected to binding processing after the punch processing and then folding processing.

FIG. 19 illustrates the sheet bundle 100 discharged in a bundled state. The ring holes rp are punched on the side near the side edge of the sheet bundle 100, and the paper sheet bundle is bound with the paper-made staple 60 by the saddle stitching staplers 50 for paper-made staple at the positions corresponding to the ring holes rp. Further, the filing holes fp are punched around the center of the paper sheet in the width direction. When the paper sheet bundle is bound in a file, a binding metal fitting is inserted through the filing holes fp. Thus, it is possible to punch the file holes in the paper sheet bundle folded in half without using a separate punching machine after binding, increasing convenience.

Figure 18:
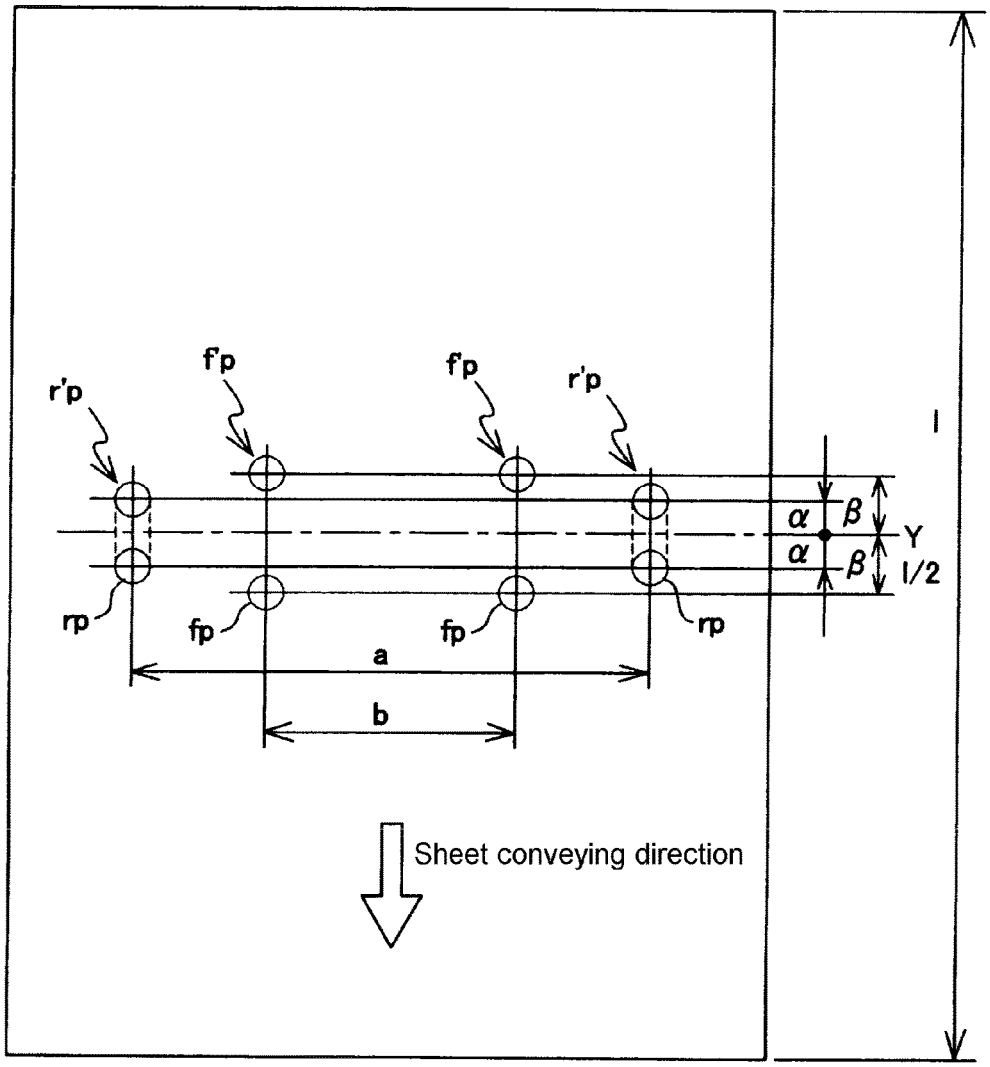
FIG. 18 is an explanatory view of a paper sheet that has been subjected to punch processing for ring binding (rp) and for filing (fp)

In the present invention, the following consideration is taken into account with respect to positions of the punch holes. When the paper sheet bundle 100 is folded in half as illustrated in FIG. 10, a deviation occurs between the innermost and outermost paper sheets in terms of a distance between the folding line corresponding to the center line 1/2L and each punch hole. That is, the paper sheet on the folding blade 46 side is folded with no paper sheet interposed between the pages thereof. On the other hand, a sheet folding thickness is added to the paper sheet on the folding roller 45 side, with the result that the position of the punch holes becomes close to the folding position. Thus, when the punch holes are punched at the same position (when distances $\alpha$ and $\beta$ of FIG. 18 are the same) in all the paper sheets to be folded, the punch holes are deviated in a case where a large number of paper sheets to be bound are folded, which may apply an excessive load to the paper-made staple and may make the filing difficult. Thus, in the present invention, intervals $\alpha$ and $\beta$ from the center line 1/2L are sequentially increased such that the paper sheet nearer to the folding roller 25 has larger values $\alpha$ and $\beta$. This reduces or eliminates the deviation of the punch position of the folded paper sheet bundle 100, facilitating penetration of the paper-made staple or filing processing. In the present embodiment, the values $\alpha$ and $\beta$ for the first paper sheet to be stacked in the stacker section 35 are set as reference values, and the values $\alpha$ and $\beta$ for the subsequent paper sheets are gradually increased. That is, the values $\alpha$ and $\beta$ for the paper sheets to be stacked last time are set to the largest values.

The operation after stacking of the paper sheets that have been subjected to the punch processing in the stacker 35, is the same as that of the saddle stitching processing not involving punch processing and only differs therefrom in that the leg portions 61 and 62 of the paper-made staple are made to penetrate the simple ring holes rp and r'p by the saddle stitching staplers 50 for paper-made staple for binding the paper sheet bundle 100. This eliminates the need to use a considerably rigid ring member for the binding, thereby simplifying the binding processing. Further, since the punch holes are previously punched, a load resistance applied to the paper-made staple 60 when the leg portions thereof are made to penetrate a stiff paper or a thick paper sheet bundle 100 can be reduced. As already described above, the folding blade 46 for pushing the paper sheet bundle 100 between the folding rollers 45*a* and 45*b* is made to abut against the adhesive portion 63 of the leg portion 62 of the paper-made staple 60 folded inward after penetration through the punch holes rp of the paper sheet bundle 100 to thereby increase the bonding strength.

[Control Configuration]

Figure 20:
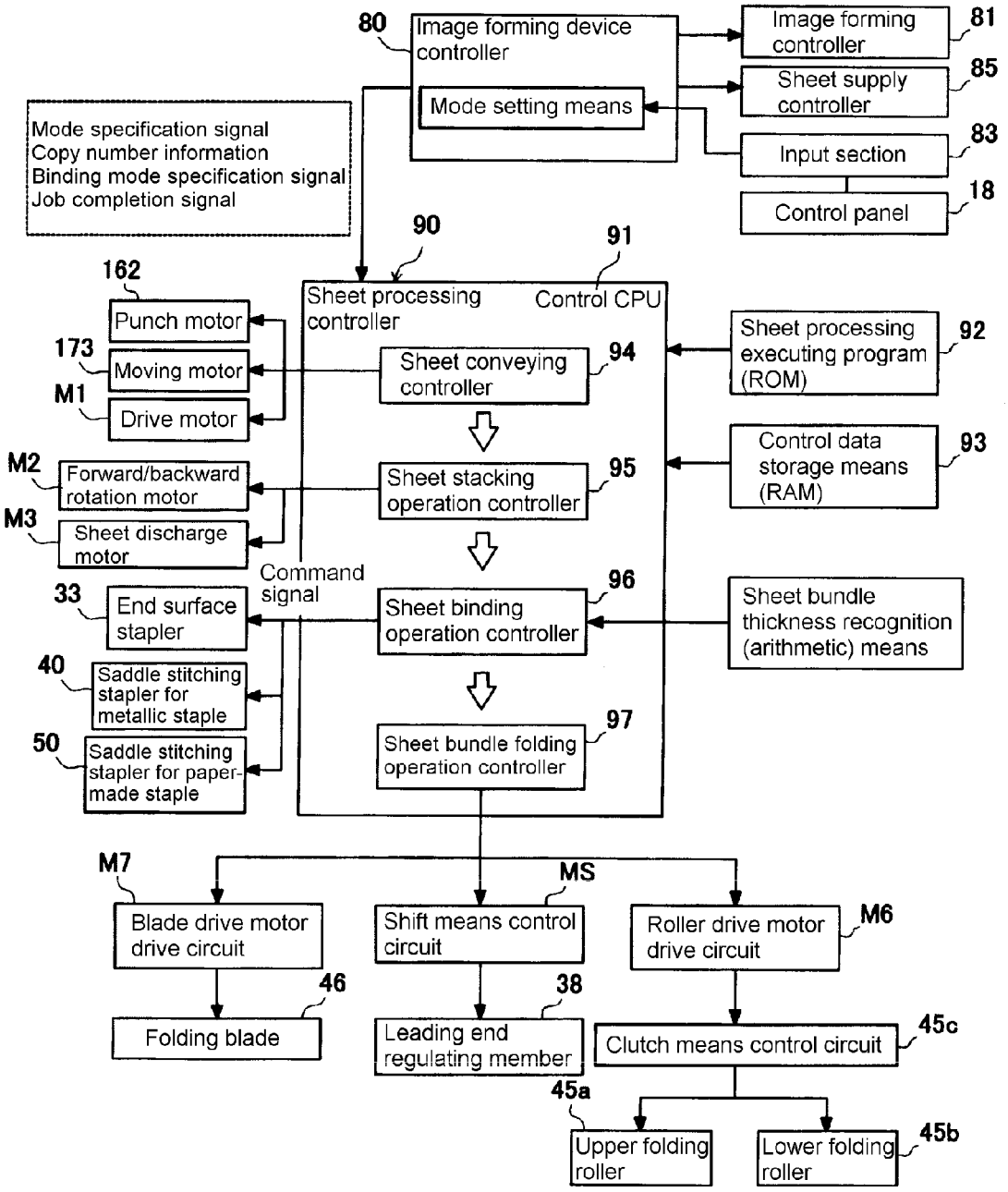
FIG. 20 is an explanatory view illustrating a control configuration of the first to fourth embodiments.

The following describes a control configuration of the above-described image forming system with reference to a block diagram of FIG. 20. The image forming system illustrated in FIG. 1 includes a controller (hereinafter, referred to as "main controller") 80 of the image forming device A and a controller (hereinafter, referred to as "sheet processing controller") 90 of the sheet processing device B. The main controller 80 includes an image forming controller 81, a sheet supply controller 85, and an input section 83. A user sets "image forming mode" or "sheet processing mode" through a controller panel 18 provided in the input section 83. As described above, in the image forming mode, the image forming conditions such as a print copy count specification, a sheet size specification, a color or black-and-white printing specification, enlarged or reduced printing specification, a single- or double-side printing specification are set. Then, the main controller 80 controls the image forming controller and sheet supply controller according to the set image forming conditions to form an image onto a predetermined paper sheet and sequentially carries out the resultant paper sheet through the main body discharge port 3.

At the same time, the user sets the sheet processing mode through the controller panel 18. The sheet processing mode includes, e.g., a "printout mode", a "side edge staple-binding mode", a "metallic staple saddle stitching mode", a "paper-made staple saddle stitching mode", and a "simple ring mode". The image forming device A forms an image onto the sheet according to the set image forming and sheet processing conditions.

The sheet processing controller 90 includes a control CPU 91 that operates the sheet processing device B in accordance with the specified sheet processing mode, a ROM that stores an operation program, and a RAM 93 that stores control data. The control CPU 91 includes a sheet conveying controller 94 that executes conveyance of the paper sheet fed to the carry-in port 23, a sheet stacking operation controller 95 that executes sheet stacking operation, a sheet binding operation controller 96 that executes sheet binding processing, and a sheet bundle folding operation controller 97 that executes sheet bundle folding operation.

The sheet conveying controller 94 is connected to a control circuit of the drive motor M1 for the carry-in roller 24 and sheet discharge roller 25 disposed in the sheet carry-in path P1 so as to receive a detection signal from a sensor S1 disposed in the sheet carry-in path P1. The sheet stacking operation controller 95 is connected to drive circuits of respective forward/backward rotation motor M2 for the forward/backward rotation roller 30 and sheet discharge motor M3 that moves a rear end regulating member to discharge the paper sheet so as to stack the paper sheets in the first processing tray 29 as a first staking section. The sheet binding operation controller 96 is connected to drive circuits of the staple motor MD, drive motor 56, and clincher motor 122 incorporated respectively in an end surface binding stapler 33 disposed in the first processing tray 29, saddle stitching stapler for metallic staple in the stacker section 35, and saddle stitching stapler 50 for paper-made staple in the stacker section 35.

The sheet bundle folding operation controller 97 is connected to a drive circuit of a roller drive motor M6 that drives the upper and lower folding rollers 45*a* and 45*b* into rotation. Further, the sheet bundle folding operation controller 97 is connected to the conveying rollers 36 and 37 of the second switchback conveying path P2 and a control circuit of the shift means MS that controls movement of the stopper 38 of the stacker section 35 to a predetermined position so as to receive a detection signal from sheet sensors in these paths.

The controller 90 thus configured controls the sheet processing device to execute the following processing operations.

[Printout Mode]

In this printout mode, the image forming device A performs image formation on a series of paper sheets from the first page and sequentially carries out in facedown the resultant paper sheets from the main body discharge port 3. Correspondingly, the sheet processing device B moves a not-illustrated path switching piece 27 so as to guide the paper sheet to the sheet discharge roller 25. Then, at a timing at which the paper sheet passes the sheet discharge roller 25, the forward/backward rotation roller 30 is moved down from an upper standby position to the processing tray 29 and is rotated in a clockwise direction in FIG. 2. Then, the paper sheet entering the processing tray 29 is carried out toward the first sheet discharge tray 21 and housed thereon. In this manner, the subsequent paper sheets are sequentially carried out to the first sheet discharge tray 21 and stacked/housed thereon.

Thus, in the printout mode, the paper sheet onto which an image has been formed by the image forming device A is stacked/housed on the first sheet discharge tray 21 through the sheet carry-in path P1 of the sheet processing device B. On the first sheet discharge tray 21, the paper sheets are sequentially stacked upward in, e.g., facedown in the order from the first page.

[Side Edge Staple-Binding Mode]

In this mode, the image forming device A performs image formation on a series of paper sheets from the first page and sequentially carries out in facedown the resultant paper sheets from the main body discharge port 3, as in the printout mode. Then, the resultant paper sheet fed to the sheet carry-in path P1 are guided by a not-illustrated path switching piece to the sheet discharge roller 25. Then, at a timing at which the paper sheet passes the sheet discharge roller 25, the forward/backward rotation roller is moved down from the upper standby position to the processing tray 29 and is rotated in a counterclockwise direction in FIG. 2. Then, the paper sheet fed through the sheet discharge roller 25 by the counterclockwise rotation of the forward/backward rotation roller 30 is conveyed in a switchback manner along the first switchback conveying path P11 branching off from the sheet carry-in path P1 toward the processing tray 29. By repeating this sheet conveying operation, a series of the paper sheets are stacked in facedown on the processing tray 29 in a bundle.

Every time the paper sheet is stacked on the processing tray 29, the control CPU 91 activates a not-illustrated side aligning plate to align width direction positions of the paper sheets to be stacked. Then, upon reception of the job completion signal from the image forming device A, the control CPU 91 activates the end surface binding stapler 33 to bind rear end edges of the paper sheet bundle stacked on the processing tray 29. After this stapling operation, the control CPU 91 moves a not-illustrated rear end regulating member serving also as a bundle carry-out means toward the first sheet discharge tray illustrated in FIG. 2.

Then, the staple-bound paper sheet bundle is carried out onto the first sheet discharge tray 21 and housed thereon. As a result, a series of the paper sheets onto each of which the image has been formed by the image forming device A are staple-bound at its side edge and housed on the first sheet discharge tray 21.

[Metallic Staple Saddle Stitching Mode]

In this mode, the image forming device A uses the sheet processing device B to bind the paper sheet bundle by the saddle stitching stapler 40 for metallic staple into a booklet form. To this end, a not-illustrated path switching piece positioned at a merging part of the sheet carry-in path P1 and second switchback conveying path P2 is moved so as to allow the paper sheet to be conveyed to the sheet discharge roller 25. As a result, the paper sheet fed to the sheet carry-in path P1 is guided by the sheet discharging roller 25. Then, with reference to a signal from the sheet sensor S1 detecting a rear end of the paper sheet, the control CPU 91 stops the sheet discharge roller 25 at a timing at which the rear end of the paper sheet passes the path switching piece and, at the same time, moves the path switching piece 27 so as to allow the paper sheet to be conveyed to the second switchback conveying path P2. Then, the sheet discharge roller 25 is rotated backward (in the counterclockwise direction in FIG. 3). Then, the conveying direction of the paper sheet entering the sheet carry-in path P1 is reversed, with the result that the paper sheet is guided to the second switchback conveying path P2 and then guided to the stacker section 35 by the conveying rollers 36 and 37 disposed in the second switchback conveying path P2.

At a timing at which the paper sheet is carried in from the second switchback conveying path P2 to stacker section 35, the sheet bundle folding operation controller 97 moves the stopper 38 for regulating the sheet leading end to the sheet receiving position Sh3 illustrated in FIG. 2 through the shift means control circuit MS for controlling movement of the stopper 38. Then, the paper sheet is supported by the stacker section 35 as a whole. In this state, the control CPU 91 activates the above-mentioned aligning member 39 to align the paper sheets in the width direction thereof. The aligning member 39 need not be activated when the first sheet is housed in the stacker section 35. Further, the aligning member 39 need not be activated every time the paper sheet is housed in the stacker section 35.

Then, the sheet bundle folding operation controller 97 moves the stopper 38 to a position slightly raised from the sheet receiving position so as to allow the sheet rear end to enter the third switchback conveying path P3. Then, the sheet rear end enters the third switchback conveying path P3 since the second switchback conveying path P2 is closed by a not-illustrated paper sheet. In this state, the subsequent paper sheets are fed from the second switchback conveying path P2 to the stacker section 35 and stacked on the preceding paper sheet. Then, in accordance with the carrying-in of the subsequent paper sheets, the stopper 38 is moved to the subsequent sheet receiving position Sh3.

Then, as above, the aligning member 39 is activated to align the carried in paper sheet and paper sheets supported on the guide with each other in the width direction. By repeating such operations, the paper sheets on each of which the image has been formed by the image forming device A are conveyed, through the second switchback conveying path P2, onto the stacker section 35 and are then aligned. Then, the sheet bundle folding operation controller receives the job completion signal and moves the stopper 38 to the metallic staple binding position Sh21 to position the center of the paper sheet bundle to the binding position.

Then, the sheet binding operation controller activates the saddle stitching stapler 40 for metallic staple to staple-bind the paper sheet bundle at two positions around the sheet center (the number of the binding positions may be changed according to the need, and, for example, one or two or more binding positions may be set). Upon reception of a completion signal of the binding operation, the sheet bundle folding operation controller 97 moves the stopper 38 to the folding position Sh1 to position the sheet center to the folding position Y. Then, the folding processing is performed for the paper sheet bundle with a sequence illustrated in FIGS. 5A to 5D, and then the resultant paper sheet bundle is carried out to the second discharge tray 22.

[Paper-Made Staple Saddle Stitching Mode]

In this mode, the image forming device A uses the sheet processing device B to bind the paper sheet bundle by the saddle stitching stapler 50 for paper-made staple into a booklet form.

The paper-made staple saddle stitching mode is basically the same as the above-described metallic staple saddle stitching mode. A difference point is that the position of the stopper 38 for binding position is set to the paper-made staple binding position Sh22. This paper-made staple binding position Sh22 is a position at which the paper-made staple 60 is driven so as to straddle the folding position Y. Thus, after the binding processing, the folding processing is performed for the paper sheet bundle with a sequence illustrated in FIGS. 10A to 10D, and then the resultant paper sheet bundle is carried out to the second discharge tray 22. In this folding operation, the paper-made staple 60 is folded and, at the same time, the leg portions 61 and 62 thereof are folded together to increase bonding strength between the leg portions. Other operations are the same as those of the metallic staple saddle stitching mode.

[Simple Ring Mode]

In this mode, the image forming device A uses the sheet processing device B perform the following processing. That is, the sheet processing device B punches punch holes at predetermined positions of the paper sheet by means of the single-sheet punch unit 28, conveys the resultant paper sheet to the stacker section 35 and aligns the conveyed paper sheets in a bundle, then performs the simple ring binding of binding the paper sheets by the saddle stitching stapler 50 for paper-made staple at the punch holes, folds the resultant paper sheet bundle in a booklet form, and houses the folded paper sheet bundle in the second sheet discharge tray 22.

In this simple ring mode, the operation of previously binding the paper sheet bundle by the saddle stitching stapler 50 for paper-made staple is the same as that in the above-described paper-made staple saddle stitching mode. The punching operation has already been described using FIGS. 16 to 19, so that descriptions thereof are omitted here. The punch operation is controlled by the sheet conveying controller 94.

Although, in the above embodiments, the saddle stitching stapler 50 for paper-made staple is used as the second binding section, the present invention is not limited to this. For example, a configuration may be employed in which crimping teeth are meshed with each other to cause local deformation in the thickness direction of the paper sheet bundle to make the paper sheets to be engaged with each other, or a cut portion is formed in a part of the paper sheet bundle for binding. In short, the second binding section should be a saddle stitching binder capable of binding the paper sheet bundle without using the metallic staple.

Fifth Embodiment

The following describes a fifth embodiment. In the fifth embodiment, the first and second binding sections are provided in a sheet processing device having a different sheet conveying path configuration from that of the above-described first to fourth embodiments.

The components represented by the same reference numerals have the same functions as those described above, and hence repeated descriptions thereof are omitted or simplified.

Figure 21:
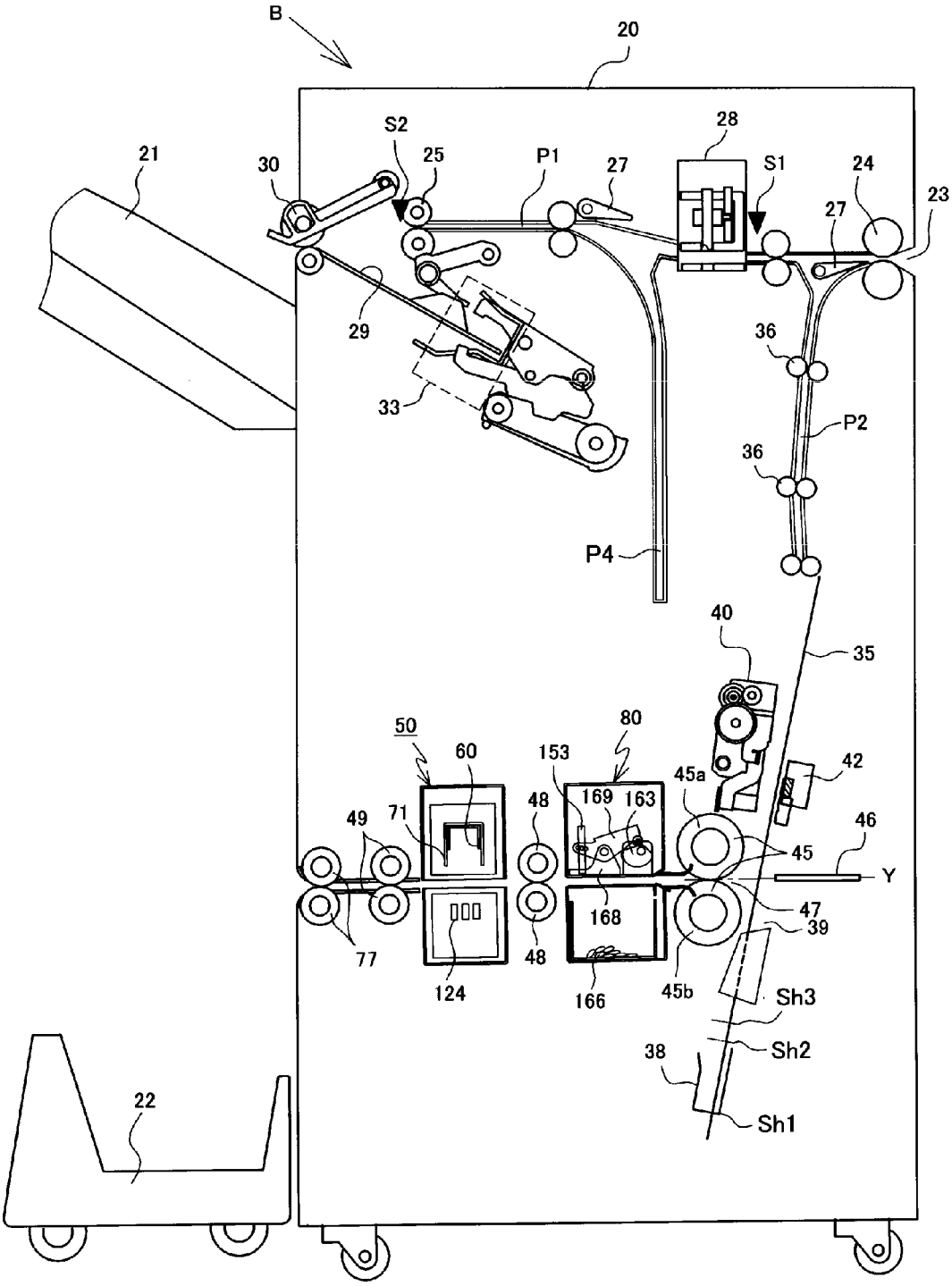
FIG. 21 is an explanatory view illustrating a sheet conveying path of the fifth embodiment which is different from those of the sheet processing devices according to the first to fourth embodiments.

The sheet processing device B illustrated in FIG. 21 selects, using the path switching piece 27, to which one of the end surface binding stapler 33 or the stacker section 35 the paper sheet discharged from the image forming device A and carried in through the carry-in port 23 is conveyed. The punch unit 28 that punches punch holes for each paper sheet is disposed in the sheet carry-in path P1 leading to the end surface binding stapler. Further, a standby passage P4 branching off from the sheet carry-in path P1 is disposed on the downstream side of the punch unit 28. The standby passage P4 is a standby position of the paper sheet switched back from the sheet carry-in path P1.

On the other hand, the conveying path P2 (in the fifth embodiment, the conveying path P2 does not switch back the paper sheet) leading to the stacker section 35 is disposed below the path switching piece 27 at the carry-in port 23. In the conveying path P2, the paper sheet to be subjected to saddle stitching or half-folding processing is conveyed, in a vertical attitude, by the conveying roller 36 and is then sequentially stacked/housed upward. In particular, the stacker section 35 illustrated in FIG. 21 is disposed in a substantially vertical direction so as to vertically cross the casing 20, whereby the paper sheet is stacked in a vertical attitude, making the device compact. Further, the stacker section 35 is shaped to have an appropriate size to house therein a maximum sized paper sheet. Further, the stacker section 35 has a shape suitable for arranging the saddle stitching stapler 40 for metallic staple described using FIGS. 3A and 3B, and folding roller 45 and folding blade 46 which are described using FIGS. 5A to 5D. The stacker section 35 has the stopper 38 for regulating the leading end of the paper sheet, and the stopper 38 is configured to be movable to an appropriate position in accordance with a sheet size (length in a sheet discharge direction) or an operation mode (carry-in to the stack tray, binding using the saddle stitching stapler 40 for metallic staple, folding operation using the folding roller 45 and folding blade 46).

That is, the position Sh3 illustrated in FIG. 21 is a position at which the paper sheet is received from the carry-in roller 36. The position Sh2 is a position at which the saddle stitching stapler 40 for metallic staple drives the metallic staple 40*a* at the center of the paper sheet bundle 100 in the sheet conveying direction. The position Sh1 is a position at which the folding blade 46 pushes the paper sheet bundle 100 to the folding roller 45 side so as to fold the paper sheet bundle 100 in half. This position is set to a position at which the position bound by the saddle stitching stapler 40 for metallic staple is folded. As illustrated in FIG. 21, the aligning member 39 for aligning the paper sheets carried in the stacker section 35 is disposed at a near side and a far side. Further, when a back 100*a* of the folded paper sheet bundle is bound by the saddle stitching stapler for paper-made staple, the folding roller 45 may fold the paper sheet bundle that has not been subjected to the binding processing.

[Multiple-Sheet Punch Unit]

Figure 22B:
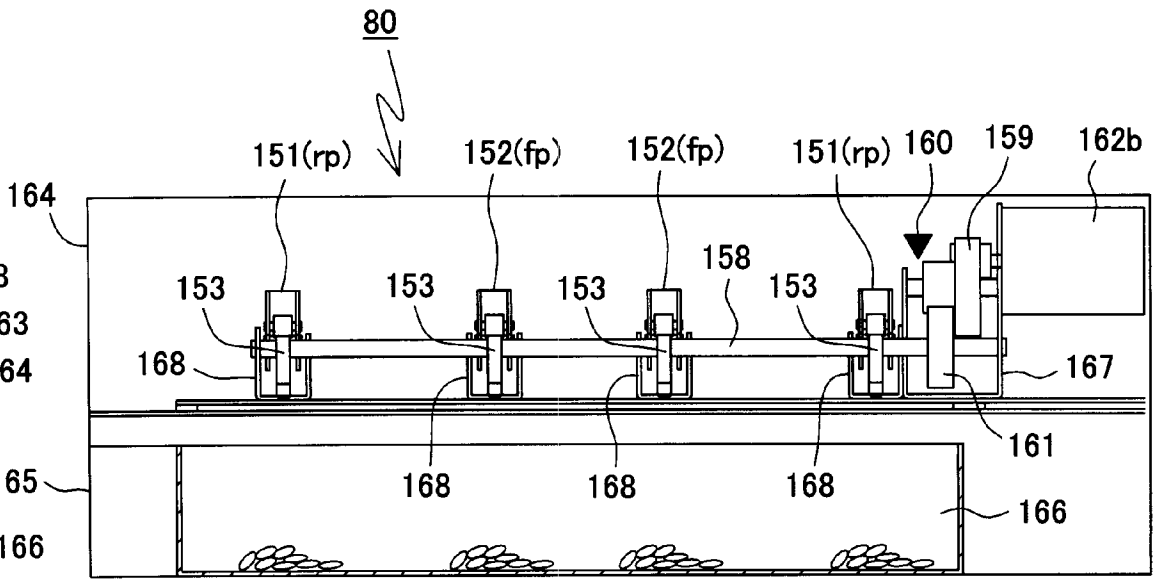
Figure 22A:
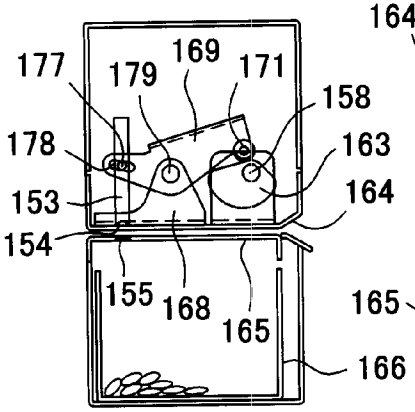

The following describes, using FIGS. 22A and 22B, a multiple-sheet punch unit 80 that collectively performs punch processing for multiple paper sheets in a bundle state (i.e., paper sheet bundle) that have been folded in half by the folding roller 45. FIG. 22A is a side view, and FIG. 22B is a cross-sectional view as viewed in the conveying direction of the paper sheet bundle 100. As illustrated in FIG. 22A, the multiple-sheet punch unit 80 is constituted by an upper guide 164 including a punch mechanism such as a punch blade 153 and a lower guide 165 including a die 155 that the punch blade 153 penetrates and a punch chip container.

There are provided, in the upper guide 164, a drive shaft 158 turned by a multiple-sheet punch motor 162*a* and a drive cam 163 fixedly mounted to the drive shaft 158. The drive cam 163 is always engaged with an operating arm 169 whose leading end is fitted to the punch blade 153. The operating arm 169 is configured to be turned about a rotary shaft of an arm support frame 168 mounted to the upper guide 164. The punch blade 153 and operating arm 169 are connected to each other such that a pin 177 of the punch blade 153 is fitted in an elongated hole 178 formed in the leading end of the operating arm 169. The other end of the operating arm 169 abuts against the drive cam 163 through a roller 171. This abutment is caused by a not-illustrated spring biasing the roller 171 to the drive cam 163. The arm support frame 168 has a punch blade guide 154 for guiding vertical movement of the punch blade 153.

In the lower guide 165, the die 155 that the punch blade 153 penetrates and punch chip container 166 are provided. The punch chip container 166 is a container for housing punch chips of the punch holes generated by the punch blade 153 penetrating the die 155 and punching punch holes in the paper sheet bundle 100. The punch chip container 166 is provided so as to be drawn from the lower guide 165.

As illustrated in FIG. 22B, the multiple-sheet punch motor 162*a* is disposed at an end portion of the multiple-sheet punch unit 80. A drive from the multiple-sheet punch motor 162*a* is input to a drive shaft 158 turning the drive cam 163 through an entrance gear 159 and a gear train. As described above, rotation of the drive shaft 158 turns the drive cam 163 to thereby vertically move the punch blade 153 up and down.

The inner two punch units (fp) 152 and outer two punch units (rp) 151 differ from each other in terms of a phase of the drive cam 163. This is because the two punch units (fp) 152 and outer two punch units (rp) 151 operate independently of each other for respective cases where punch holes (rp) for simple ring through which the paper-made staple 60 penetrates are punched at the leading end 100*a* of the folded paper sheet bundle 100 and where punch holes (fp) for filing the half-folded paper sheet bundle 100 are punched.

Thus, the outer two punch units function as the ring punch units (rp) and inner two punch units function as the filing punch units (fp). The paper sheet bundle 100 folded in half by the folding blade 46 and folding roller 45 is conveyed between the upper guide 164 and lower guide 165 by the folding roller, and the paper sheet bundle 100 is punched in one shot.

There is disposed, on the downstream side of the multiple-sheet punch unit 80 and in a direction crossing the conveying direction of the paper sheet bundle 100, an after-punch pressure roller 48 that pressurizes the folded paper sheet bundle 100 conveyed from the multiple-sheet punch unit 80 in the folding direction (overlapping direction) so as to surely imparting a folding line.

A saddle stitching stapler 50 for paper-made staple has substantially the same configuration as the saddle stitching stapler 50 for paper-made staple of FIG. 6, so that detailed descriptions thereof are omitted here. A different point is that the saddle stitching stapler 50 for paper-made staple in this embodiment drives the paper-made staple 60 at the back 100*a* side of the half-folded paper sheet bundle 100.

[Operation of Cutter Blade of Saddle Stitching Stapler for Paper-Made Staple]

Figure 23C:
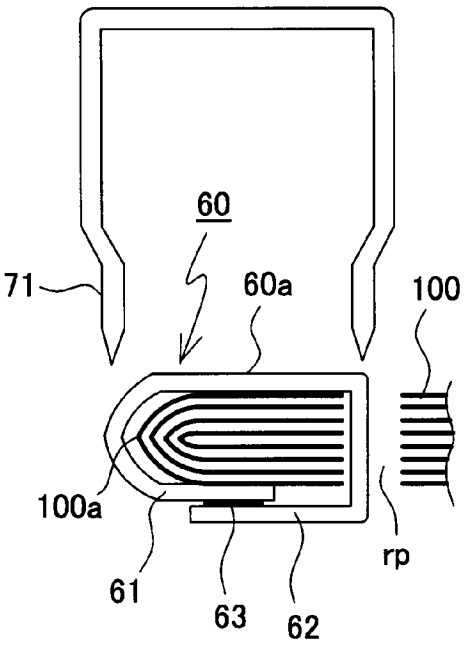
Figure 23B:
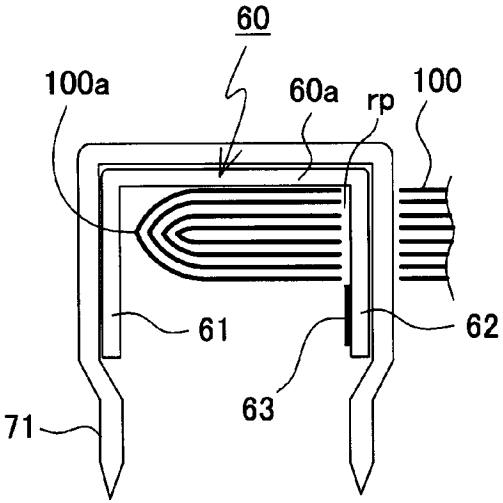
Figure 23A:
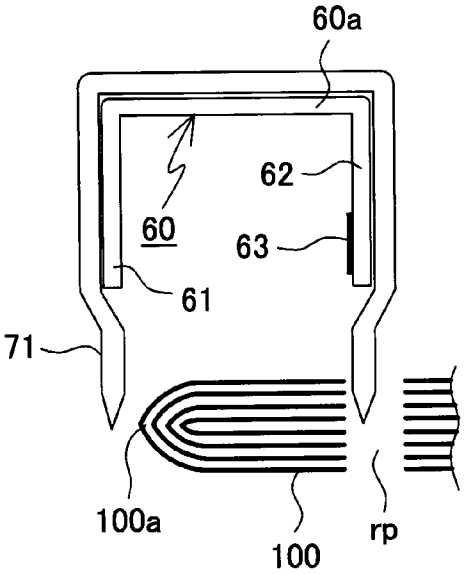

The following describes how to bind the back 100*a* of the paper sheet bundle 100 with reference to FIGS. 23A to 23C. FIGS. 23A to 23C illustrate the cutter blade 71 provided at a leading end of the driver 53 so as to allow the paper-made staple 60 to penetrate through the paper sheet bundle 100 and its operation.

The paper sheet bundle 100 has been subjected to the punching processing by the multiple-sheet punch unit 80 positioned on the upstream side of the saddle stitching stapler 50 for paper-made staple. That is, the ring punch holes (rp) have been punched at the leading end 100*a* of the paper sheet bundle 100. The one leg portion 62 of the pair of leg portions is made to penetrate the ring punch hole (rp), and the other leg portion 61 is positioned outside the leading end 100*a* of the half-folded paper sheet bundle 100.

FIG. 23A illustrates a state where the paper-made staple 60 formed into a U-shape by the forming plate 115 is set to the cutter blade 71 by the pusher 117 illustrated in FIG. 6. FIG. 23B illustrates a state where the cutter blade 71 and paper-made staple 60 set thereto move down. In this state, the one leg portion 62 of the paper-made staple 60 is inserted through the ring punch hole (rp) of the paper sheet bundle 100 while being retained by the cutter blade 71, and the other leg portion 61 is situated at a position going over the leading end 100*a* of the folded paper sheet bundle 100 in the downward direction.

Thereafter, the leg portions 61 and 62 of the paper-made staple 60 are bent inward and bonded to each other by the pushing unit 124 and clincher unit 57. Thereafter, synchronously with this operation, the driver 53 moves upward, and the paper sheet bundle 100 is bound by the paper-made staple 60.

Thereafter, the cutter blade 71 returns to its original position as illustrated in FIG. 23C and waits for next paper-made staple 60. In this manner, the leading end 100*a* of the paper sheet bundle 100 is bound. Thus, when the ring punch holes (rp) are punched by the multiple-sheet punch unit 80, the simple ring-bound paper sheet bundle illustrated in FIG. 19 is obtained; on the other hand, when the punch holes are not punched, the folded paper sheet bundle 100 bound with the paper-made staple illustrated in FIG. 15B is obtained.

[Plane Arrangement of Members from Multiple-Sheet Punch Unit to Saddle Stitching Stapler for Paper-Made Staple]

Figure 24:
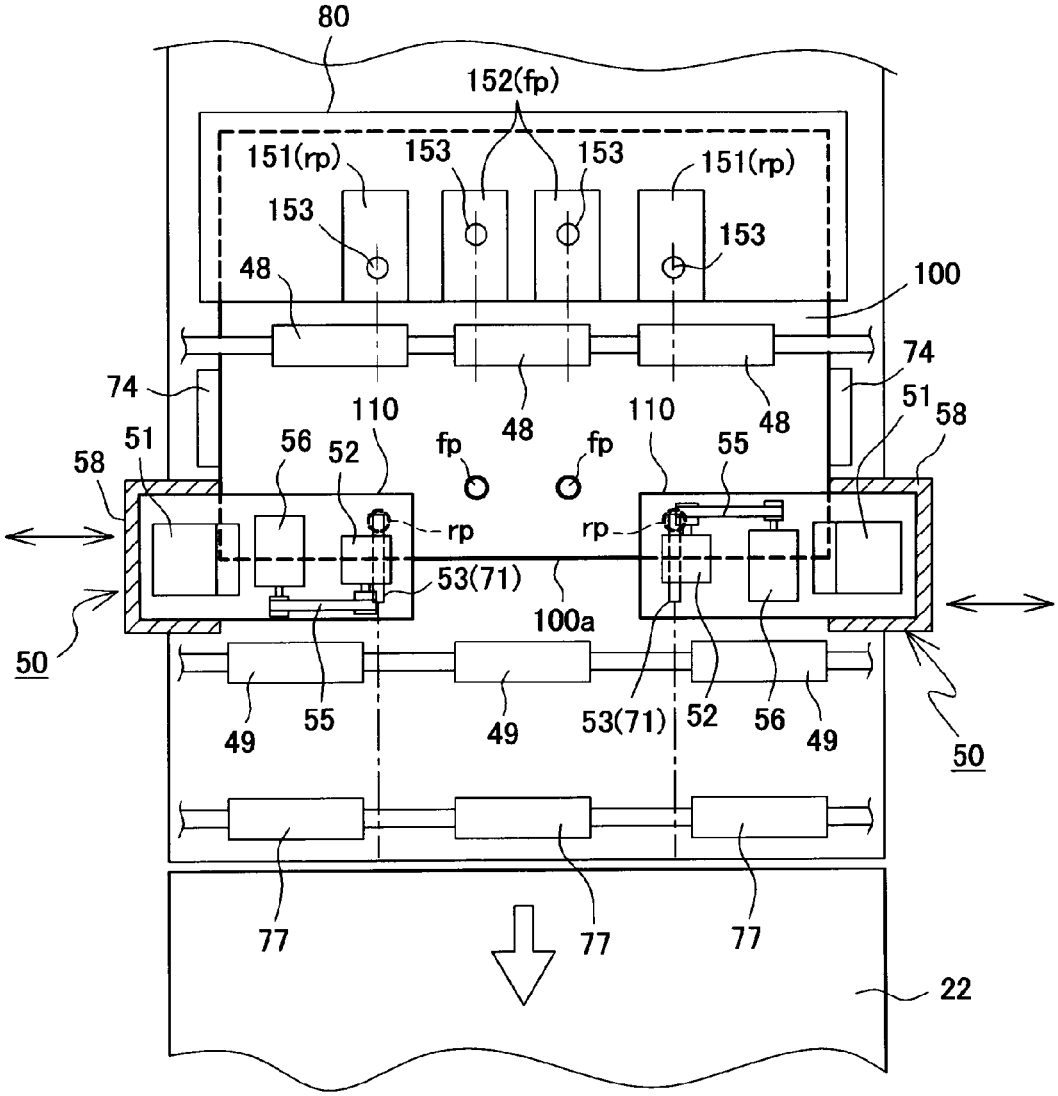
FIG. 24 is a view illustrating a plane arrangement of the multiple-sheet punch unit and binding section of the fifth embodiment.

Here is a description of a plane arrangement of the fifth embodiment. More specifically, the following describes, with reference to FIG. 24, a plane arrangement of the members provided on the downstream side of the folding roller 45, including the multiple-sheet punch unit 80, after-punch pressure roller 48 disposed in the direction crossing the conveying direction of the paper sheet bundle 100, saddle stitching stapler 50 for paper-made staple, a pressure roller 49 disposed in the direction crossing the conveying direction of the paper sheet bundle 100, and a bundle discharge roller 77 for discharging the paper sheet bundle. FIG. 24 illustrates a state where the back 100*a* (folded part) of the conveyed paper sheet bundle 100 folded in half by the folding roller 45 is situated at the binding position of the saddle stitching stapler 50 for paper-made staple.

The multiple-sheet punch unit 80 is disposed on the downstream side of the folding roller 45 and punches, at both sides of the paper sheet bundle in the width direction, the ring punch hole (rp) through which the paper-made staple 60 penetrates around the back 100*a* of the paper sheet bundle 100. The multiple-sheet punch unit 80 punches the filing punch holes (fp) using the punch blade 153 around the center of the paper sheet bundle in the width direction. On the downstream side of the punch blade 153, the after-punch pressure roller 48 that presses the paper sheet bundle from both front and rear sides is disposed in an area pressing the punched punch holes. The after-punch pressure roller 48 is configured to press the folding part of the half-folded paper sheet bundle more reliably and to press burrs or projections around the punch hole generated when the punch holes fp and rp are punched by the punch blade 153 to flatten a surface of the paper sheet bundle. This suppresses the burrs or projections around the punch hole from being caught in the conveying path during conveyance of the paper sheet bundle 100 in which the punch holes fp and rp have been punched. Although not illustrated, the after-punch pressure roller 48 is pressurized at its roller shaft by a spring.

There is disposed, on the downstream side of the after-punch pressure roller 48, a bundle aligning plate 74 that aligns the conveying position of the folded paper sheet bundle. The bundle aligning plate 74 presses the paper sheet bundle from both sides in the width direction so as to prevent deviation of the conveying position. There is disposed, on the downstream side of the bundle aligning plate 74, the saddle stitching stapler 50 for paper-made staple on an appropriate carriage 58 on both left and right sides in the figure.

When the ring punch hole punched by the multiple-sheet punch unit 80 reaches the cutter blade 71, the conveyance of the paper sheet bundle 100 is stopped, and the saddle stitching stapler 50 for paper-made staple performs binding processing as illustrated in FIG. 23C. After completion of the binding processing by the saddle stitching stapler 50 for paper-made staple, the paper sheet bundle is conveyed for discharge. There is disposed, on the downstream side of the saddle stitching stapler 50 for paper-made staple, the pressure roller 49. The pressure roller 49 is configured to surely impart a line, as well as the after-punch pressure roller 48. There is disposed, on the downstream side of the pressure roller 49, the bundle discharge roller 77. As illustrated in FIG. 24, the pressure roller 49 and bundle discharge roller 77 are configured to press the paper sheet bundle, avoiding the position at which the paper-made staple 60 is made to penetrate the ring punch holes (rp) by the saddle stitching stapler 50 for paper-made staple and bind the paper sheet bundle 100. The above-described after-punch pressure roller 48 is configured to press the punch holes (rp, fp) punched by the multiple-sheet punch unit 80, while the pressure roller 49 and bundle discharge roller 77 are configured to press the paper sheet bundle, avoiding the binding position so as to prevent catching with the paper-made staple 60, thus preventing peeling of the binding and the like.

[Control Configuration]

Figure 25:
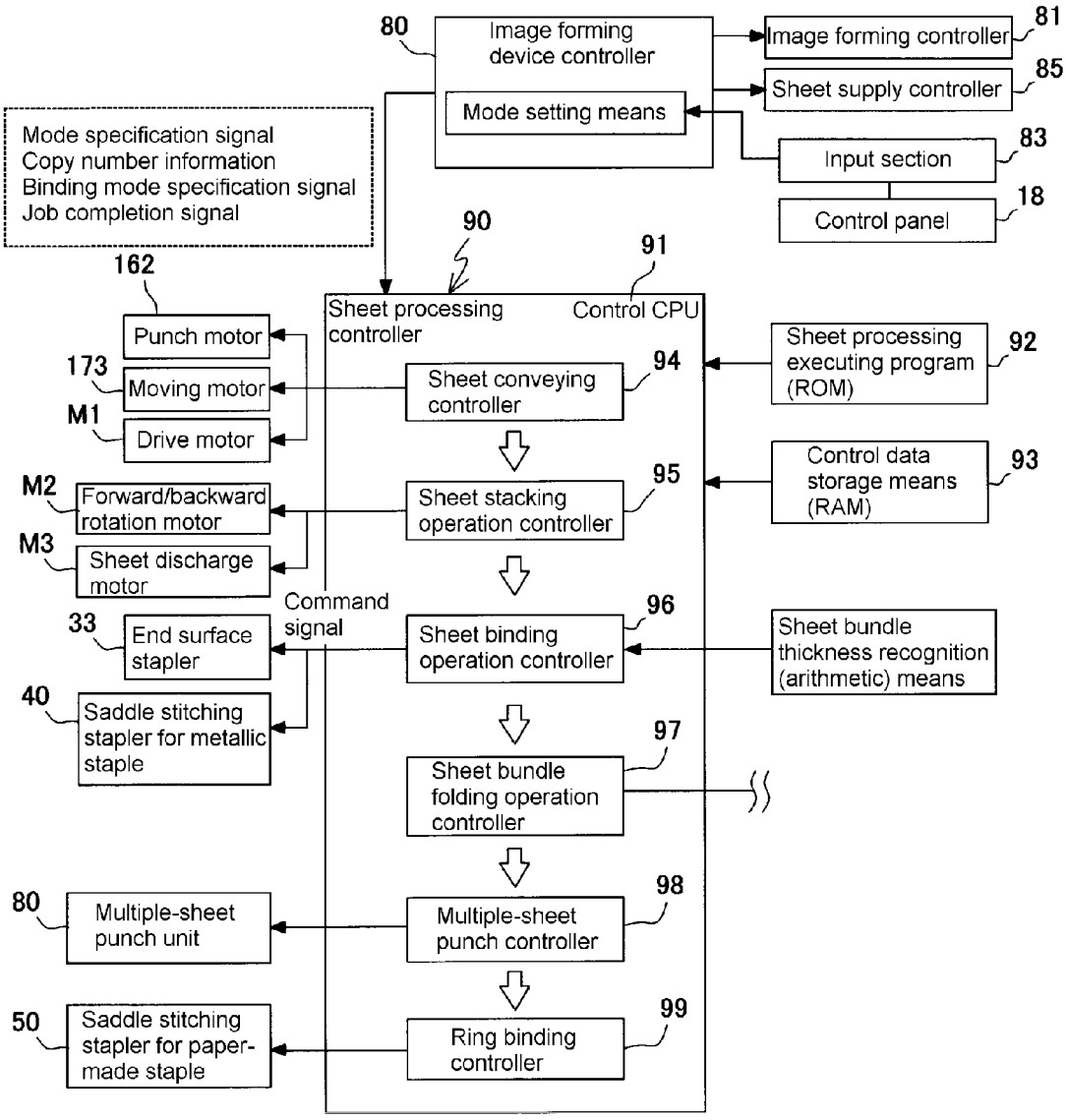
FIG. 25 is an explanatory view illustrating a control configuration of the fifth embodiment.

The following describes a control configuration of the fifth embodiment with reference to FIG. 25. A different point from the control configuration illustrated in FIG. 20 is that a multiple-sheet punch controller 98 for controlling the multiple-sheet punch unit 80 and a ring binding controller 99 for controlling the saddle stitching stapler 50 for paper-made staple are added after the sheet bundle folding operation controller 97 in the figure. With this configuration, whether or not to perform the multiple-sheet punch processing for the paper sheet bundle 100 or whether or not to perform simple ring binding using the punch holes is controlled. Although omitted in FIG. 24, the sheet bundle folding operation controller 97 is connected to the shift means control circuit MS and the like as illustrated in FIG. 20.

Under control of the above controllers, also in the fifth embodiment, the "paper-made staple saddle stitching mode" or "simple ring mode" described in the first to fourth embodiments can be executed by the multiple-sheet punch unit 80 or saddle stitching stapler 50 for paper-made staple which are disposed on the downstream side of the folding roller 45.

What is claimed is:

1. A sheet processing device that saddle stitches and folds in half a paper sheet bundle, comprising:

a stacker section that temporarily stacks conveyed paper sheets in a substantially vertical attitude;

a stopper that regulates the paper sheets stacked in the stacker section;

a first binding section that is provided in the stacker section and saddle-stitches, with a metallic staple, a paper sheet bundle regulated by the stopper at a binding position around a center of the paper sheet bundle in a sheet conveying direction;

a second binding section that is provided in the stacker section and saddle-stitches, without using the metallic staple, the paper sheet bundle regulated by the stopper at the binding position around the center of the paper sheet bundle in the sheet conveying direction; and a folding section that folds in half the paper sheet bundle regulated by the stopper at a folding position at which the paper sheet bundle is bound by the first binding section or second binding section, wherein the first binding section and second binding section are disposed in the stacker section and on both sides of the folding section, respectively, in the sheet conveying direction.

2. The sheet processing device according to claim 1, wherein the first binding section is disposed on an upstream side of the folding section, and the second binding section is disposed on a downstream side of the folding section.

3. The sheet processing device according to claim 1, wherein the second binding section is disposed on an upstream side of the folding section, and the first binding section is disposed on a downstream side of the folding section.

4. The sheet processing device according to claim 1, wherein the second binding section binds the paper sheet bundle using a paper-made staple.

5. The sheet processing device according to claim 4, wherein the folding section includes a folding blade that presses the paper sheet bundle stacked in the stacker section in a direction crossing the paper sheet bundle and a folding roller that folds the paper sheet bundle pressed by the folding blade, and in the binding processing of the paper sheet bundle by the second binding section, the paper-made staple is driven such that a back part thereof straddles the folding position in a direction crossing the folding position, and in the folding processing of the paper sheet bundle, leg portions of the paper-made staple are pressed against the paper sheet bundle by the folding blade.

6. The sheet processing device according to claim 4, further comprising, on an upstream side of the stacker section, a punch unit that punches punch holes for each paper sheet conveyed, wherein the second binding section makes the paper-made staple penetrate the punch holes to bind the paper sheet bundle.

7. An image forming device comprising:

an image forming unit that forms an image onto paper sheets; and a sheet processing device that performs processing for the paper sheets fed from the image forming unit, the sheet processing device having the configurations as claimed in claim 1.

* * * * *